US007918724B2

(12) United States Patent
Walker et al.

(10) Patent No.: US 7,918,724 B2
(45) Date of Patent: Apr. 5, 2011

(54) CONDITIONAL APPLICATION OF HIT CARD

(75) Inventors: Jay S. Walker, Ridgefield, CT (US); Russell P. Sammon, San Francisco, CA (US); Gregory J. Scribner, New Milford, CT (US); Jeffrey Y. Hayashida, San Francisco, CA (US); Renny S. Talianchich, London (GB)

(73) Assignee: IGT, Reno, NV (US)

( * ) Notice: Subject to any disclaimer, the term of this patent is extended or adjusted under 35 U.S.C. 154(b) by 60 days.

(21) Appl. No.: 12/255,361

(22) Filed: Oct. 21, 2008

(65) Prior Publication Data

US 2009/0189349 A1 Jul. 30, 2009

Related U.S. Application Data

(60) Provisional application No. 61/023,331, filed on Jan. 24, 2008.

(51) Int. Cl.
*A63F 1/00* (2006.01)

(52) U.S. Cl. ..... 463/12; 273/292

(58) Field of Classification Search ..... 273/292, 273/274, 309; 463/12, 13
See application file for complete search history.

(56) References Cited

U.S. PATENT DOCUMENTS

| | | | | |
|---|---|---|---|---|
| 6,257,979 | B1 | 7/2001 | Walker et al. | |
| 6,808,173 | B2 * | 10/2004 | Snow | 273/292 |
| 7,201,655 | B2 | 4/2007 | Walker et al. | |
| 7,416,186 | B2 | 8/2008 | Walker et al. | |
| 2004/0033830 | A1 | 2/2004 | Gold et al. | |
| 2004/0043807 | A1 | 3/2004 | Pennington | |
| 2005/0073100 | A1 * | 4/2005 | Falciglia | 273/292 |
| 2006/0046816 | A1 | 3/2006 | Walker et al. | |
| 2006/0172789 | A1 | 8/2006 | Walker et al. | |

* cited by examiner

*Primary Examiner* — Benjamin H Layno
(74) *Attorney, Agent, or Firm* — K&L Gates LLP

(57) ABSTRACT

Methods, devices, systems and computer readable media are described, comprising determining an intermediate player hand in a card game; offering to the player an option to receive a conditional hit card in exchange for resolving the hand according to a second pay table; if the player accepts the offer, dealing a conditional hit card face down to the player; determining a final dealer hand; and if the final dealer hand beats the intermediate player hand, turning the conditional hit card face up and adding the card to the intermediate player hand, thereby determining a final player hand; awarding a payout to the player according to the reduced pay table if the final player hand beats the final dealer hand.

27 Claims, 23 Drawing Sheets

200

200

CONDITIONAL APPLICATION OF HIT CARD

The present application claims priority to U.S. Patent Application No. 61/023,331, filed Jan. 24, 2008, entitled "CONDITIONAL APPLICATION OF HIT CARD."

DETAILED DESCRIPTION

Figure 1A:
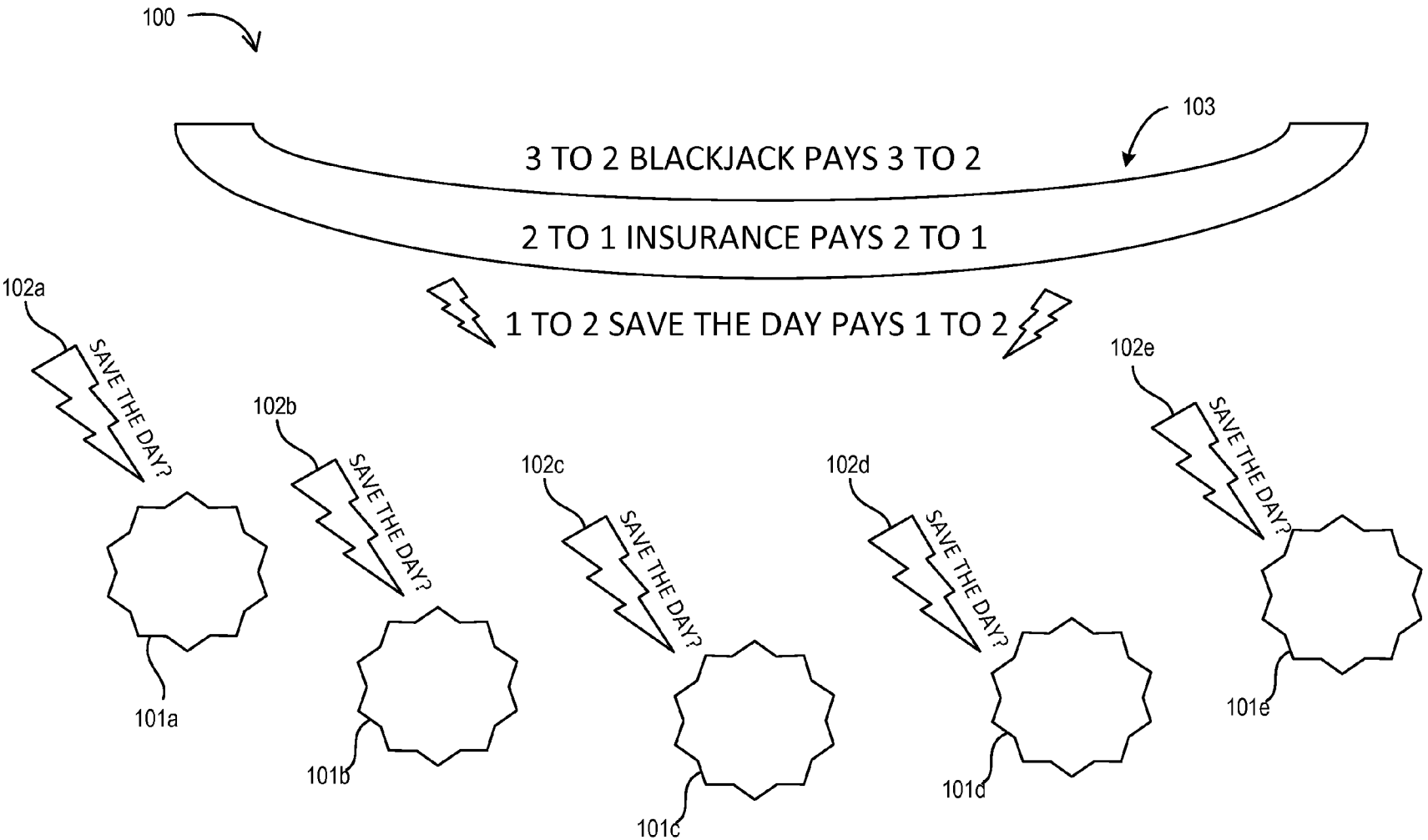
FIGS. 1*a*-1*e* illustrate a blackjack table game according to one or more embodiments.

Many casino table games such as blackjack use player input such as hit-cards to add an element of player skill and to increase player engagement in the games. However, these games have been extensively analyzed and researched, to the point that optimal strategy (known in blackjack as "basic strategy") can be easily learned and retained by regular players; basic strategy tables are available for most rule variants being used in casinos today. One drawback is that, because optimal blackjack strategy is relatively easy to learn and apply, the excitement is reduced because the "correct" play is always known.

Additional bets such as insurance may be used, but these traditional secondary bets may be similarly familiar and predictable. At the same time, it is not desirable to alter the basic rules of these games, because the rules are widely known and are consistently used by casinos around the world.

Thus, many embodiments described herein disclose casino card games, such as blackjack and European Baccarat, in which a player may choose to be dealt a conditional hit card during play of a hand, such that the conditional hit card may be optionally used after the player receives more information. In exchange for the option to use the conditional hit card, the player may agree to a modified pay table, place an additional bet, pay a fee, or provide some other consideration in exchange for the added opportunity to win the hand. One advantage is that basic strategy becomes much challenging to calculate, and adds to the excitement of the game.

The following terms are used throughout the present application:

"Standard Game" refers to a card game, e.g., blackjack, that uses standard or traditional rules. Many of applicants' embodiments may be variants on a standard game, with example of where the rules of the embodiment diverge from the rules of the standard game.

"Player" refers to an individual who places a wager against another individual. Typically, one or more Players will wager against a "Dealer," often referred to as the "House," and representing a casino operator or other gaming entity.

"Initial Wager" refers to a wager placed at the beginning of a hand, round, game, play, etc. In blackjack, an initial wager is placed at the beginning of a hand, before any cards have been dealt in the hand. An initial wager is present in a standard game as well as in many of applicants' embodiments.

"Initial Round" refers to a round that takes place after an initial wager has been placed, and before a player or dealer decision has been made. In blackjack, the initial round may comprise dealing two cards each to the dealer and to each player.

"Initial Hand" refers to a group of cards associated with a specific player or dealer during the initial round. In blackjack, a player's initial hand may consist of two exposed cards, and the dealer's hand may consist of one face down card and one exposed card.

"Hit Card" refers to a card that is added to an initial hand. In blackjack, each player may ask for a hit card, dealt one at a time, as many times as desired, in order to get as close to 21 as possible without going over ("busting"). The blackjack dealer may also hit, usually following a specific set of rules, e.g., hit on 16 or lower, hit (or stand) on "soft" 17.

To "Stand" means to decline an additional hit card. In blackjack, standing typically creates a final hand for the player, which is compared to the dealer's final hand once the dealer has either busted or made a hand totaling 17 or higher.

To "Double Down" is to place a bet that doubles the size of the initial wager, after the initial hand has been dealt, in exchange for one, and only one hit card.

To "Split" is to place a second wager that allows a player to convert his initial hand into two initial hands splitting the two cards of the initial hand into the first card of two respective new initial hands. Under the conventional rules of blackjack, a player may only split an initial hand if the initial hand is a pair (two cards of the same rank).

"Insurance" is a second wager that acts as a hedge against a possible dealer blackjack. If a dealer's face up card (the "upcard") is an ace, the player may make an insurance bet at 2-1 odds that the dealer's face down card (the "downcard") is a ten or face card.

"Intermediate Hand" in some embodiments can also be called the "Final Starting Hand," and refers to the hand following a stand by the player. Conventionally, there can be no further changes to the player's Final Starting Hand, but in many of Applicants' embodiments, there are additional opportunities to modify the Final Starting Hand, thus the hand may also be called an Intermediate Hand. The terms Final Starting Hand and Intermediate Hand may be used interchangeably herein.

"Secondary Round" refers to play that occurs after the Initial Round, i.e., after the initial hands have been dealt, and ending when both the players and the dealer have obtained their Final Starting Hands/Intermediate Hands.

"Secondary Wager" refers to a wager that is made after the player's Intermediate Hand has been established. In some embodiments, the Secondary Wager may be made before the Dealer's Intermediate Hand has been established, and may be made after the Dealer's Intermediate hand has been established in other embodiments. The secondary wager in many embodiments is equal to or proportional to the initial wager (referred to as a "proportional wager"), but in some embodiments, the secondary wager may vary with respect to the initial wager (a "variable secondary wager"), or may be a fixed amount (a "fixed secondary wager").

"Fee" refers to a payment that may be made to the game operator, e.g., the casino, in exchange for a Conditional Hit Card (described below) or other consideration. In many embodiments, the fee has the same net effect as a secondary wager, depending on the pay tables used in different embodiments. That is, in many embodiments, the fee is a fixed amount, regardless of the size of the initial wager (referred to as a "fixed fee"), and may have the same effect as a fixed secondary wager. In some embodiments, the fee may be variable (a "variable fee") and may have the same net effect as a variable secondary wager. In some embodiments, the fee can be equal to or proportional to the initial wager (a "proportional fee"), and may also have the same net effect as a secondary wager. Examples using fees or wagers but having the same net effect are described in detail below. However, as explained in detail below, even though a secondary wager and a fee may appear to have the same monetary effect on a player, a fee may be legally distinct from a secondary wager in many jurisdictions and may have different tax implications for the player and operator as well.

"Conditional Hit Card (CHC)"/"Save the Day" refers to a hit card that is exposed after the conclusion of the Secondary Round and may be used to improve a player's hand after the Intermediate/Final Starting Hand has been established. "Save the Day" refers to some embodiments where, e.g., a CHC may be used to potentially change a player loss into a player win.

"Face Down CHC" refers to a Conditional Hit Card that is initially dealt face-down to a player at some point prior to combining the card with the Intermediate Hand.

"Face Up CHC" refers to a Conditional Hit Card that is dealt face up to a player. In some embodiments, the Face Up CHC is immediately added to the Intermediate Hand. In other embodiments, the player is given the option of adding the Face Up CHC immediately, at some point in the future, or both.

To "Expose" a card, such as a CHC, is to turn the card face up or otherwise make the contents of the card available and generally known, e.g., to a player. It should be noted that the contents of the card may be read and stored by an electronic tracking or security system, e.g., a smart shoe or under-table camera without being "exposed."

To "Activate" a CHC is to combine the card with a player's hand, e.g., an Intermediate Hand. In many embodiments, Activation occurs simultaneously with Exposing the CHC, but in some embodiments, e.g., embodiments wherein a CHC is dealt face up, the CHC may not be immediately activated.

"Conditional Hit Card Hand"/"Final Hand" refers to the player's hand after the player has either added the Conditional Hit Card the Intermediate Hand, or alternatively, or has declined to add the CHC. The Final Hand is compared to a dealer's Final Hand to determine a win and payout, if applicable.

"The Set" refers to the final hands of the players and the dealer, i.e., after all of the Final Hands have been established and player wins and losses may be determined.

"Final Round" refers to play that occurs after the Secondary Round, i.e., after the Intermediate hands for the players and dealer have been determined, up to the establishment of the Set, i.e., the establishment of Final Hands for the players and the dealer.

"Win" refers to an outcome wherein the Player beats the Dealer or House. For example, a win in blackjack occurs when a Player's Final Hand is 21 or less and wherein the Dealer's Final Hand is a bust or else is less than the Player's Final Hand. Normally, a player win pays 1-1. A player blackjack generally pays 3-2. Payouts for a win that includes the addition of a CHC vary according to different embodiments and are discussed in detail below.

"Loss" refers to a Player failing to beat or tie the Dealer or House. For example, a blackjack loss occurs when a player busts, or when a Dealer's Final Hand is 21 or less and exceeds the Player's Final Hand. The player loses his initial (and secondary) wager in the event of a loss.

"Push" refers to a Player's Final Hand and Dealer's Final Hand being equal. Generally, a push results in a player's initial wager being returned. However, in many of the embodiments described below, a push may be treated differently depending on whether a CHC is available or has been used.

"Add On" refers to embodiments where the CHC is added to a player's Intermediate Hand.

"Swap" refers to embodiments where the player has the option of replacing one card in his intermediate hand with the CHC.

"Baccarat" refers to another table game popular in casinos worldwide. In "American Baccarat," a bettor bets on either the "player" or "banker" position, and cards are dealt according to predetermined rules. "European Baccarat" refers to a variant of the Baccarat table game in which the bettor (always betting on the Player position) has the option of standing or drawing a third card on a five (5), and the dealer (always at the Bank position) can have the option to draw or stand on the third card. Unlike "American Baccarat," in which there are no player decisions such as whether to draw an additional card, the opportunity to draw an additional "hit" card in European Baccarat mid-hand allows for additional embodiments employing conditional hit cards. In this application, the generic term Baccarat will generally refer to European Baccarat unless indicated otherwise. As will be discussed below, some embodiments are applicable to American Baccarat as well and will be so identified.

FIGS. 1*a*-1*e* illustrate a blackjack table game according to one or more embodiments.

FIG. 1*a* illustrate a table game felt 100 in accordance with one embodiment. The felt 100 contains a plurality of betting circles 101*a-e* and respective "Save the Day?" areas 102*a-e*. Additional graphics 103 displaying payouts for blackjack (3-2), insurance (2-1) and Save the Day (1-2) are also located on the felt 100.

Figure 1B:
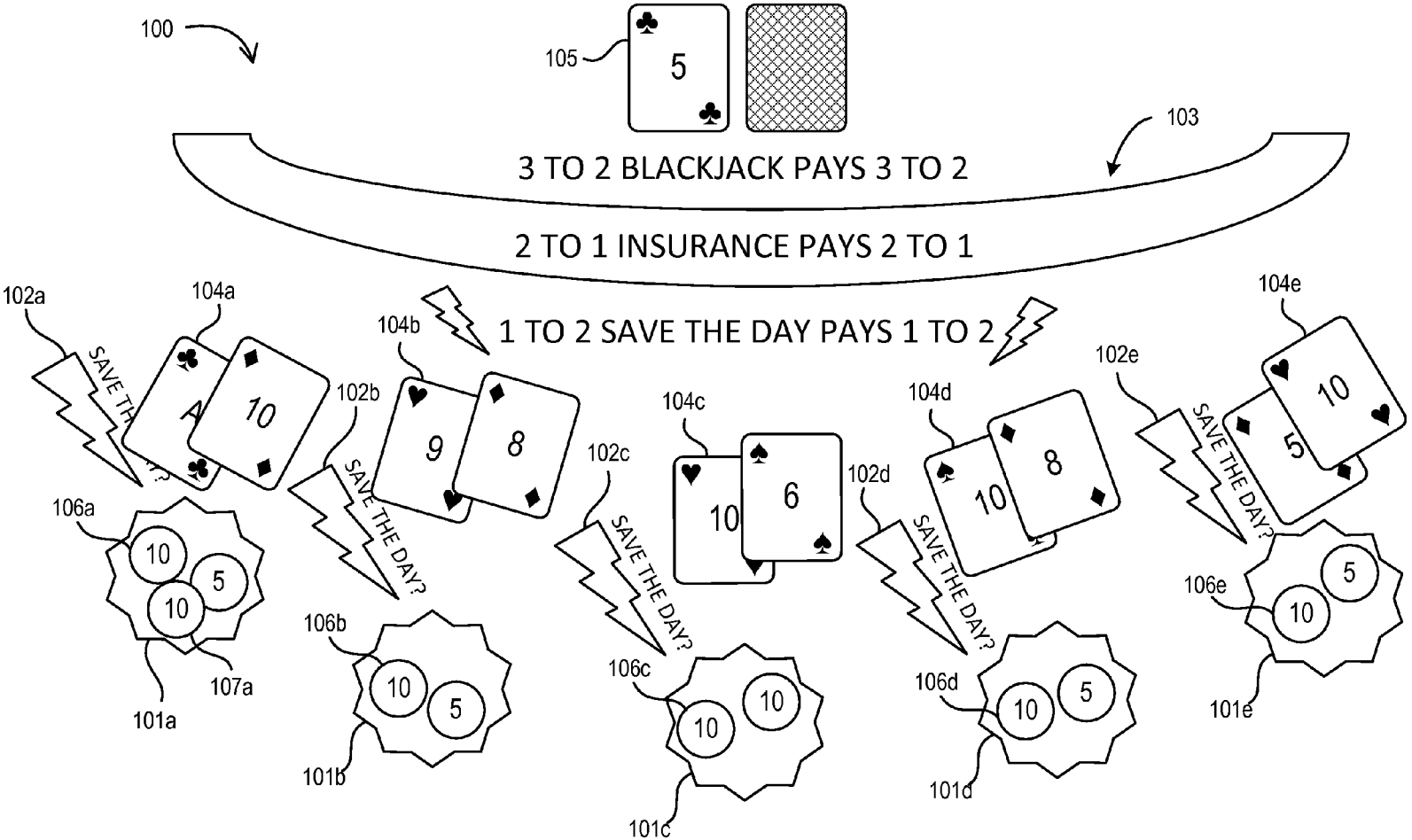

FIG. 1*b* illustrate the felt after initial hands have been dealt to the players and dealer. Each player places an initial wager 106*a-e* in the betting circle 101*a-e* and receives two cards face up 104 (the initial hand). In this embodiment, Hand 104*a* is a blackjack and is paid 3-2 immediately. Hand 104*b* is a 17, Hand 104*c* is a 16, Hand 104*d* is an 18, and Hand 104*e* is a 15. The dealer's hand 105 has one downcard and one upcard (a five (5)). At this point, each player has an opportunity to take as many hit cards, one at a time, until he reaches 21, elects to stand, or busts. Employing basic blackjack strategy, all four remaining players in this embodiment elect to stand, because a dealer is more likely to bust when his upcard is a five, regardless of a player's hand. At this point, each player has established his Final Starting Hand/Intermediate Hand.

Figure 1C:
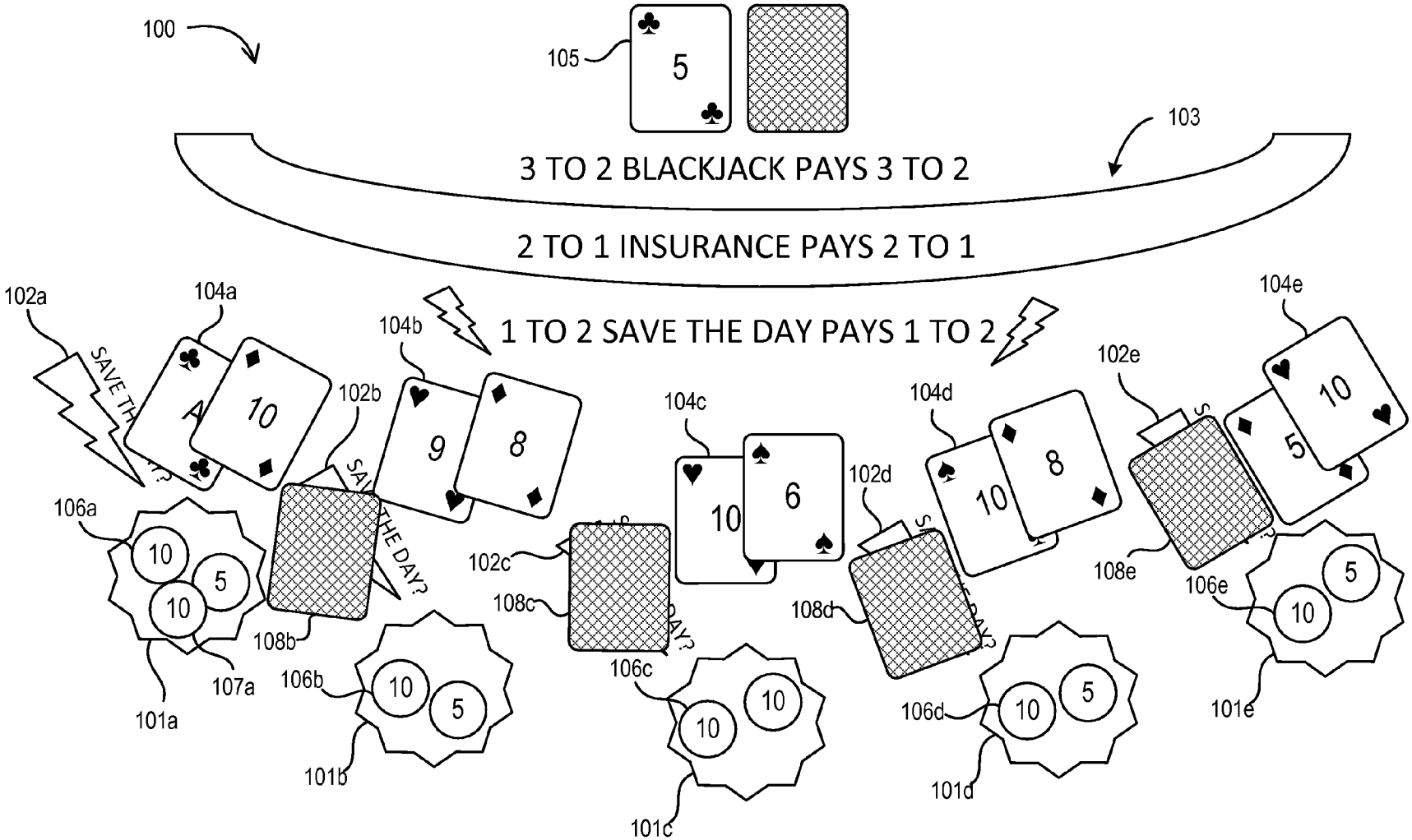

Turning now to FIG. 1*c*, in this embodiment, a face down conditional hit card 108*a-e* is dealt to the Save the Day area 102*a-e* of each respective player prior to the resolution of the dealer's hand. In this embodiment, no fee or additional wager is required to receive or use a CHC.

Figure 1D:
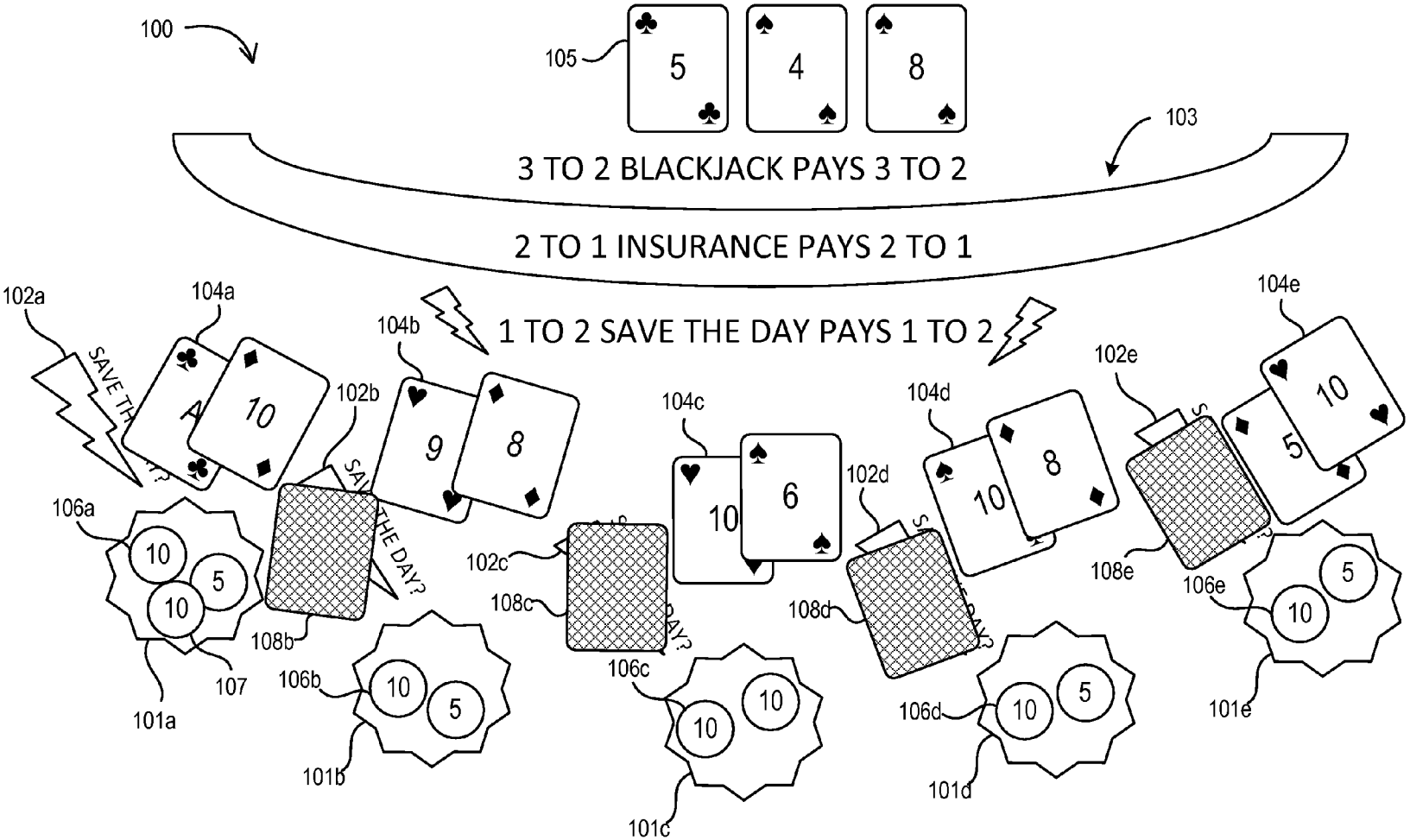

In FIG. 1*d*, the dealer's hand 105 is resolved by exposing his downcard and following the standard rules for the dealer (e.g., hit on 16 or less, stand on 17 or higher). In this example, the dealer's downcard was a four (4), forcing the dealer to hit. The dealer's hit card is an eight (8); the dealer stands on 18.

At this point, intermediate hand 104*b* is 17, which is less than the dealer's 18, and will be likely to activate his CHC in an attempt to "save the day." Intermediate hand 104*d* has a 15, also likely to activate of the conditional hit card. Intermediate hand 104*c* is 20, winning $20 (a 1-1 payout) without needing to expose and/or activate his CHC. Intermediate hand 104*d* is 18, tying the dealer's hand. Under the standard rules of blackjack, a tie generally results in a push, but in some embodiments, this results in a loss, encouraging the player to expose his CHC as well. In any event, in this embodiment, intermediate hand 104*c* elects not to activate the CHC.

Figure 1E:
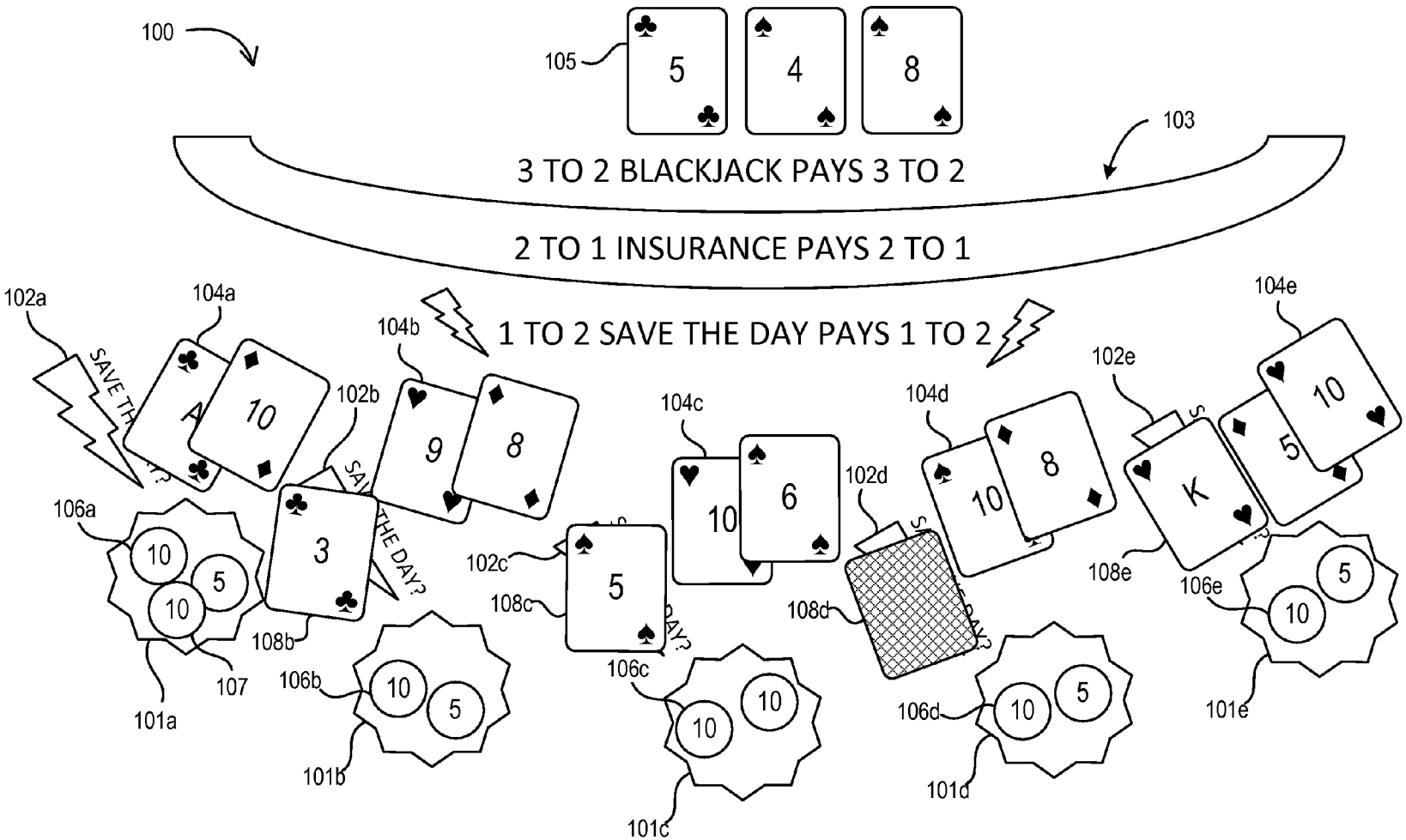

Turning now to FIG. 1*e*, CHC 108*b*, a three (3), is added to the intermediate hand 104*b*, making 21 and beating the dealer and winning a reduced payout of $7.50 (a 1-2 payout, per the felt display 103). CHC 108*e*, a King, is added to intermediate hand 104*e*, busting the player.

FIGS. 2*a*-2*e* illustrate a screen at a gaming device according to one or more embodiments.

Figure 2A:
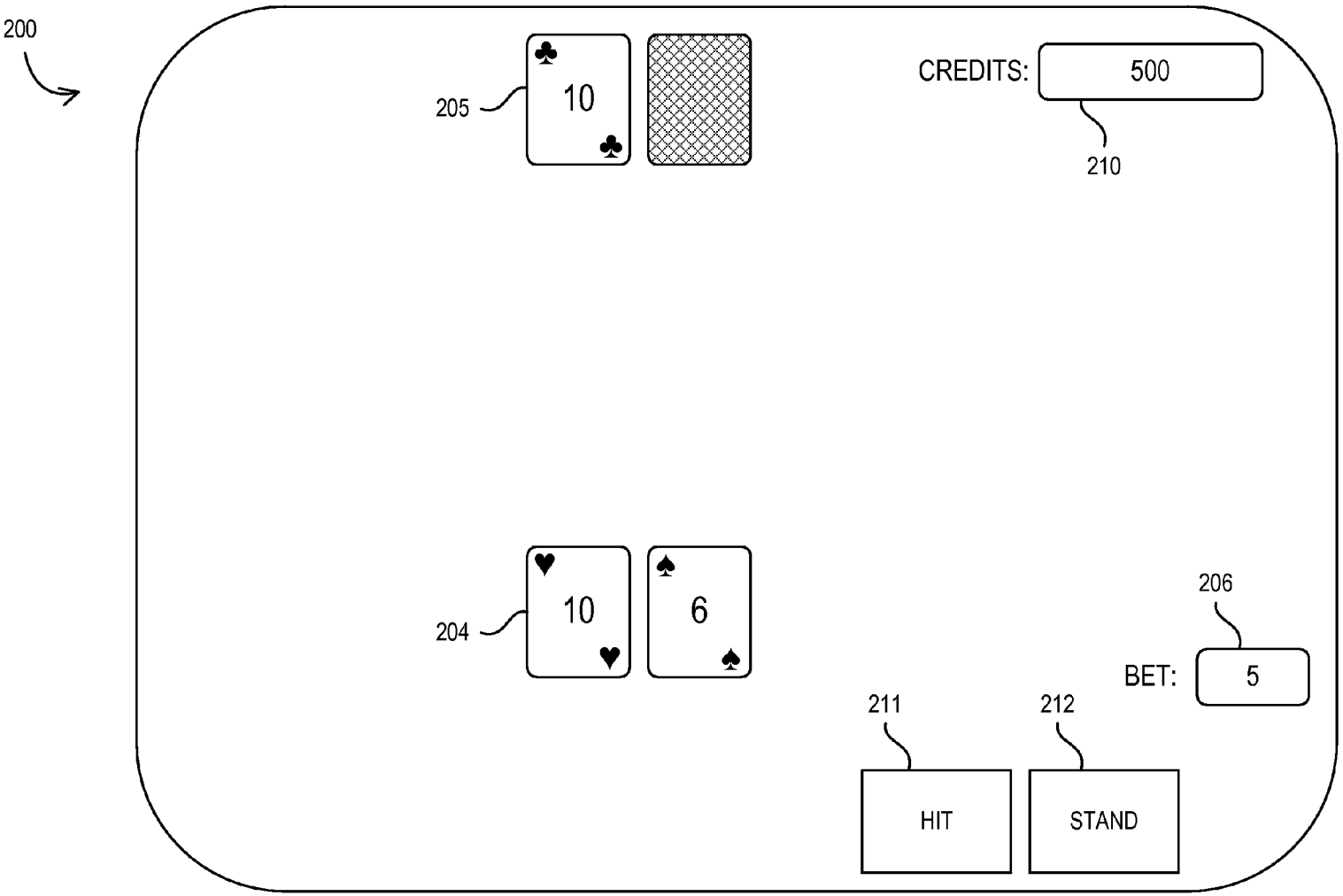
FIGS. 2*a*-2*e* illustrate a screen at a gaming device according to one or more embodiments.

FIG. 2*a* illustrate screen 200, containing a display of an initial dealer hand 205, an initial player hand 204, a credit meter balance 210, a bet display 206, and buttons representing hit 211 and stand 212 options. In this embodiment, the buttons are part of a touch screen display 200, but these actions could just as easily be performed via any manner of player input. The initial player hand has two cards face up (ten (10) and six (6)), totaling 16, and the initial dealer hand 205 has one downcard and one upcard (a ten (10)). In this embodiment, the player elects to stand by pressing the stand button 212, establishing an intermediate hand.

Figure 2B:
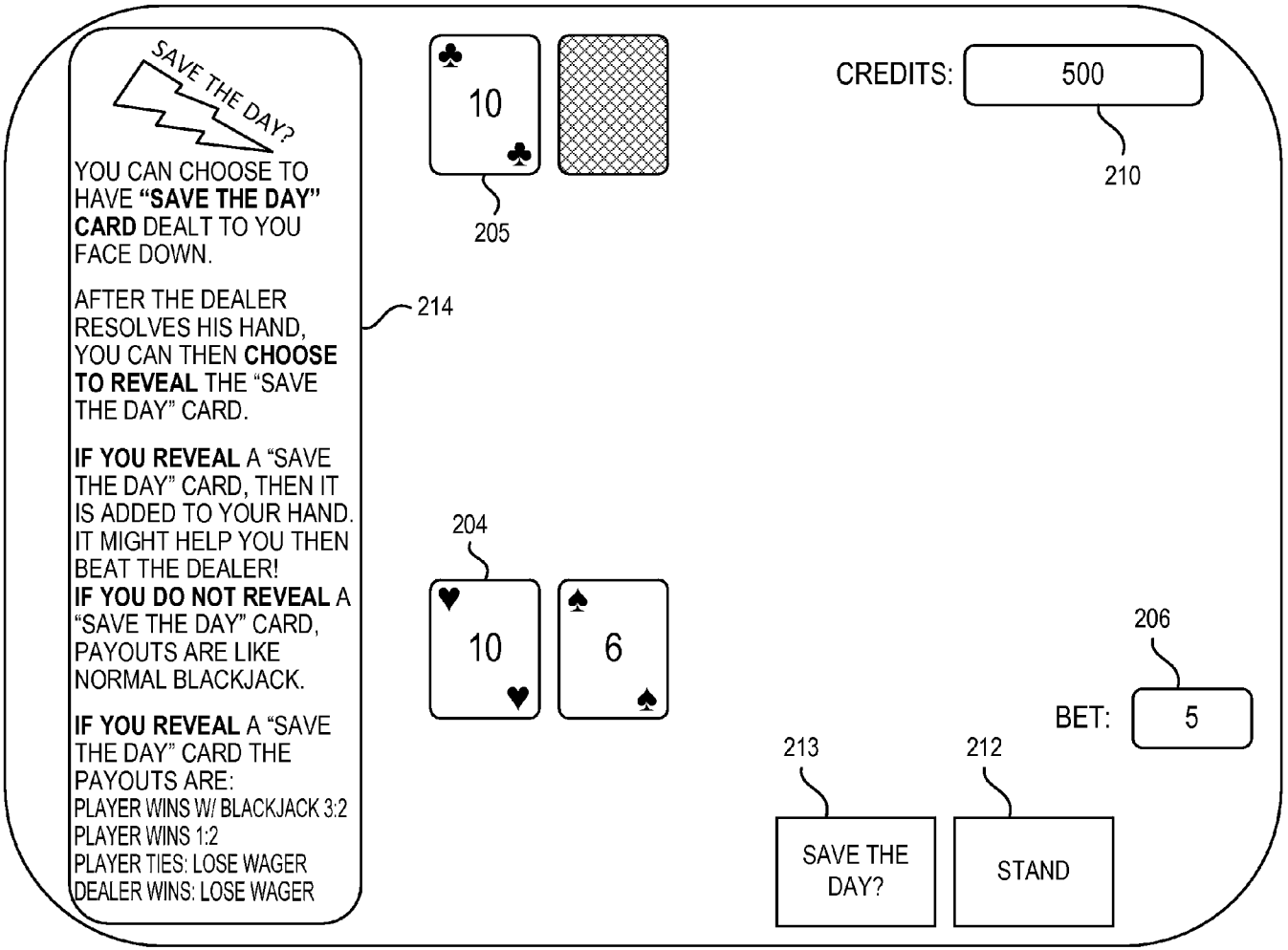

Turning now to FIG. 2*b*, the hit button is replaced by a "Save the Day?" button 213 in response to the player's stand selection, and an informational message 214 appears containing information about the "save the day" option. Alternatively, the "Save the Day?" button 213 can appear alongside the Hit button 211 (see FIG. 2*a*). One reason for replacing the Hit button would be in situations where basic strategy dictates that a hit would not be favorable, or in situations, like the present embodiment, where the player has already indicated that he does not want another hit. Alternatively, the Hit button 211 may be retained alongside the "Save the Day?" button 213 as a way of offering more options to the player.

Figure 2C:
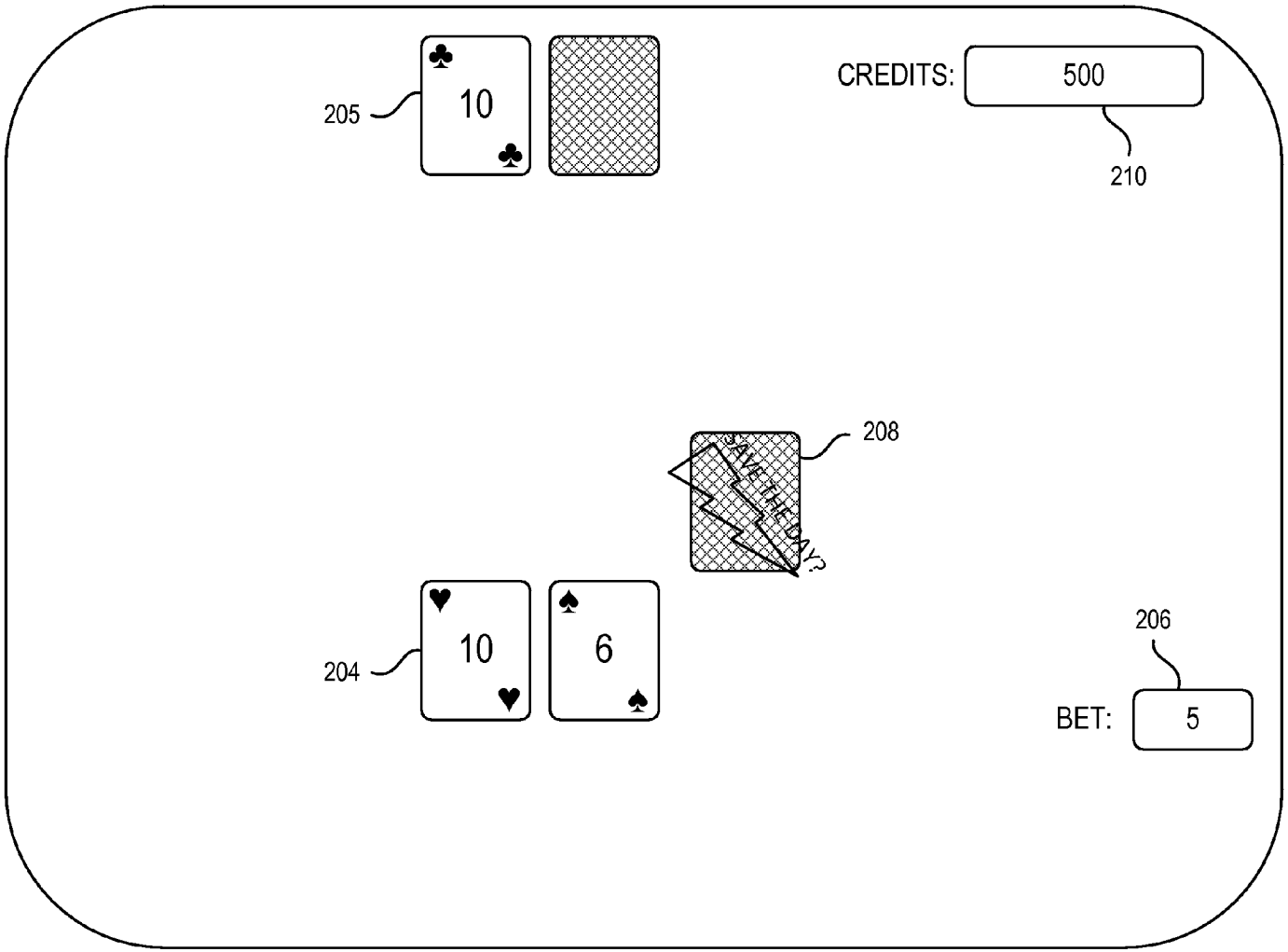

According to FIG. 2*c*, if the player presses the "Save the Day?" button 213 (or otherwise accepts a conditional hit card by another alternative input method), a face down "save the day" card 208 appears next to the player's intermediate hand 204.

Figure 2D:
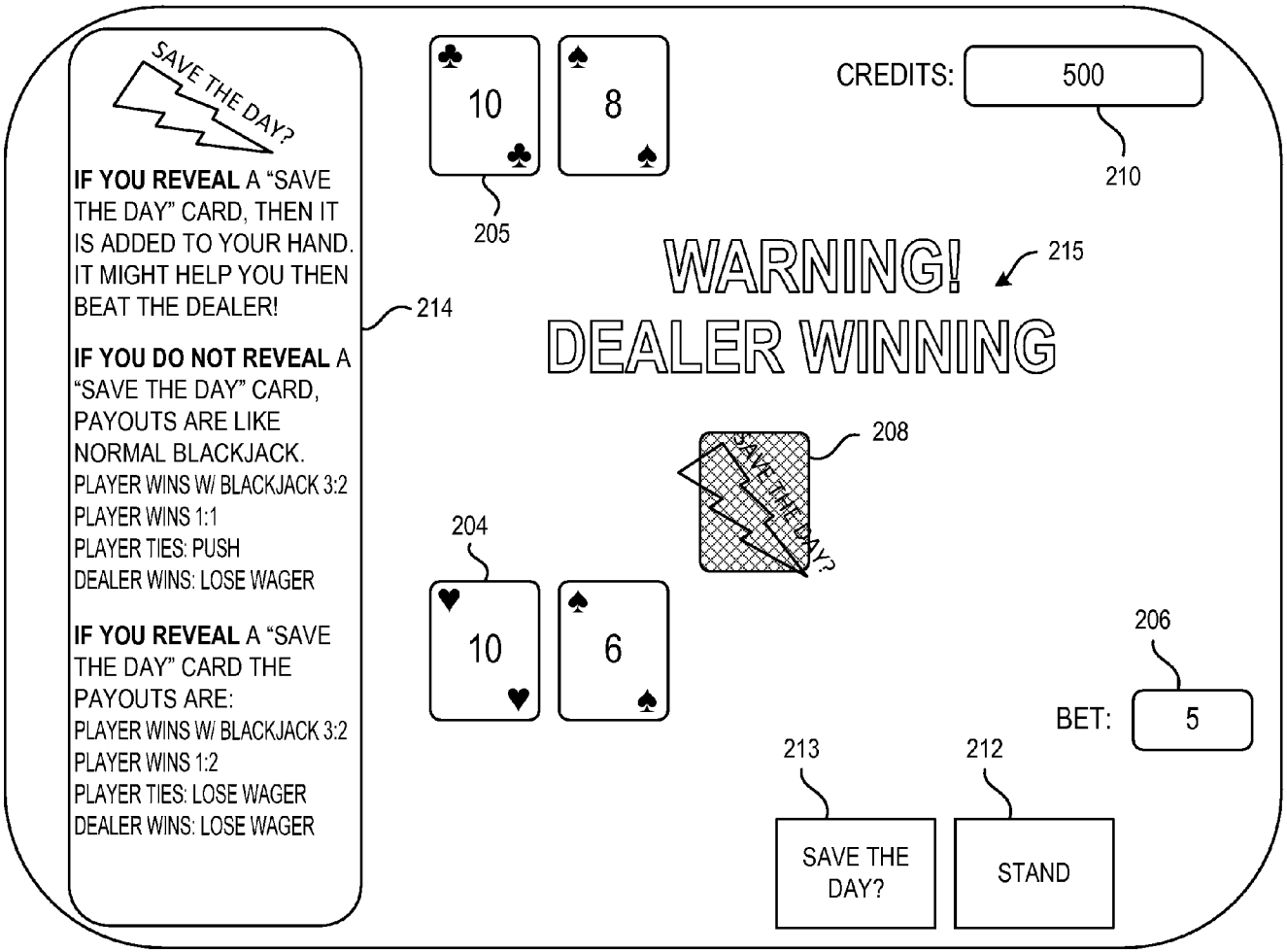

Turning now to FIG. 2*d*, as the dealer's hand is resolved, the player may be given the option of exposing the CHC/"Save the Day" card 208. In many embodiments, the option is presented after the Dealer's final hand has been established, but the option may be given at any time after the dealer's upcard is exposed, and may be given at a plurality of stages. In this embodiment, the dealer's upcard is an eight (8) and the dealer stands on 18. A warning message 215 is displayed, stating "WARNING! Dealer Winning," and a message relating to rules and payouts for exposing the CHC are displayed 216.

Alternatively, if the dealer's upcard requires a hit by the dealer, a player may be presented with the option to activate the CHC before the dealer takes a hit, after the dealer hits, and/or after any additional hits that the dealer must take. These additional opportunities may be accompanied by further adjustments to the pay schedule. For example, when the dealer has an unfavorable hand, such as a 16, a player may be convinced to activate his CHC with an otherwise marginal hand, such as 13 in exchange for a higher than normal payout, such as 3-2. Payouts may be determined in a number of ways.

In many embodiments, as a way of maintaining simplicity, payouts for hands using a CHC are predetermined, e.g., at 1-2, and do not vary. At the other hand, a payout can be calculated based on each individual combination of player and dealer cards. These calculated payouts can maintain, raise or lower the house edge as desired. In other embodiments, certain general situations may trigger a change in potential payout. For example, if standing by a player has a positive expected value, the player can be encouraged to expose and/or activate his CHC by offering an increased payout, thereby rewarding what would otherwise be considered a "sucker play." On the other hand, if standing by a player has negative expected value, the player can be encouraged to "have it both ways" by delaying his hit in exchange for a reduced payout.

Figure 2E:
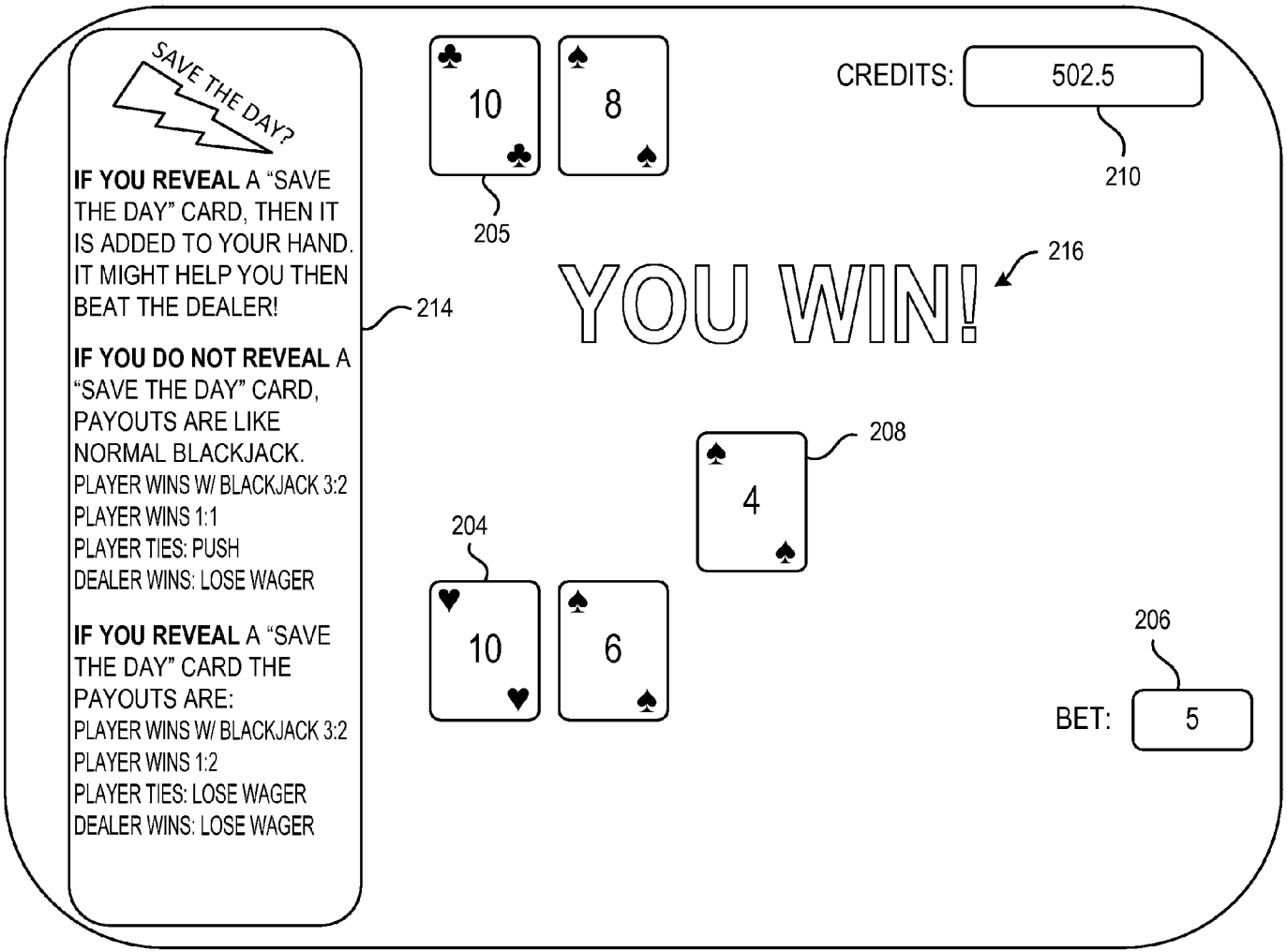

FIG. 2*e* illustrate the exposed CHC 208 (a four (4)), which combines to form a final player hand of 20. According to the rules display 216, the player receives a 1-2 payout, which is reflected in the credit meter balance 210. As discussed elsewhere, in some embodiments, a pay table including standard payouts may be retained in exchange for receiving a secondary wager or fee for receiving and/or exposing the CHC.

Although embodiments employing a conditional hit card may be implemented at a gaming device, an electronic gaming device is not required to implement all such embodiments. For embodiments that do employ a gaming device, the gaming device may be implemented as a system controller, a dedicated hardware circuit, an appropriately programmed general-purpose computer, or any other equivalent electronic, mechanical or electromechanical device. The gaming device may comprise, for example, a video blackjack machine, a video baccarat game, or a table-top game. The gaming device may be the game or the gaming device may include software to simulate play of the game as desired. In various embodiments, a gaming device may comprise, for example, a personal computer (e.g., which communicates with an online casino Web site), a telephone (e.g., to communicate with an automated sports book that provides gaming services), or a mobile terminal (e.g., a cellular telephone, a personal digital assistant (PDA), a pager, a handheld computer or the like). The gaming device may comprise any or all of the gaming devices of the aforementioned systems. In some embodiments, a user device such as a mobile terminal may be used in place of, or in addition to, some or all of the gaming device components (e.g., as the user interface for the gaming device), or as mentioned above, the mobile terminal may be the gaming device. For example, in some embodiments, a gaming device may comprise a wireless handheld device similar to the WifiCasino GS™ offered by Diamond I Technologies™ of Baton Rouge, La. Further, a gaming device may comprise a personal computer or other device, which may be operable to communicate with an online casino and facilitate game play at the online casino.

In some embodiments (e.g., in an embodiment in which a server manages downloadable games playable on one or more gaming devices), the memory may store databases. Examples of such databases include, but are not limited to, (i) a gaming device database that stores information related to one or more gaming devices with which the controller is operable to communicate; (ii) a game database that stores information regarding one or more games playable on downloadable and/or currently active in association with one or more gaming devices; and (iii) a scheduling and/or configuration database useful for determining which games are to be made available on which gaming devices.

Similarly, in one embodiment a server may be operable to configure a gaming device remotely, update software stored on a gaming device and/or to download software or software components to a gaming device. For example, a server may be operable to apply a hot fix to software stored on a gaming device, modify a payout and/or probability table stored on a gaming device and/or transmit a new version of software and/or a software component to a gaming device. A server may be programmed to perform any or all of the above functions based on, for example, an occurrence of an event (e.g., a scheduled event), receiving an indication from a qualified casino employee and/or other person (e.g., a regulator) and/or receiving a request from a player. Alternately or additionally, in some embodiments, a "peer-to-peer" relationship between a first and second gaming device may be utilized, such that a first gaming device may store content in one or more databases which may be accessed by a second gaming device, a first gaming device may remotely configure a second gaming device, and so on.

The gaming device may also include and/or be operable to communicate with various output devices. In some embodiments, an output device comprises a display device. The display device may comprise, for example, one or more display screens or areas for outputting information related to game play on the gaming device, such as a cathode ray tube (CRT) monitor, liquid crystal display (LCD) screen, or light emitting diode (LED) screen. In one or more embodiments, a gaming device may comprise more than one display device. For example, a gaming device may comprise an LCD display for displaying electronic reels and a display area that displays rotating mechanical reels. The display device may comprise, for example, one or more display areas. For example, one of the display areas (e.g., a primary game screen) may display outcomes of games played on the gaming device (e.g., electronic reels of a gaming device). Another of the display areas (e.g., a secondary game screen) may display rules for playing a game of the gaming device. Yet another of the display areas may display the benefits obtainable by playing a game of the gaming device (e.g., in the form of a payout table).

Of course, as would be understood by one of ordinary skill in the art, a gaming device may comprise various combinations of such component devices. For example, in one or more embodiments, the gaming device may include more than one display device, one or more other output devices, several input devices, and so on (e.g., two display screens, two audio speakers, a ticket-in/ticket-out device and several buttons).

The term "computer-readable medium" as used herein refers to any medium that participates in providing instructions to a processor of the gaming device (or any other processor of a device described herein) for execution. Such a medium may take many forms, including but not limited to, tangible media and memories, non-volatile media, volatile media, and transmission media. Non-volatile media include, for example, optical or magnetic disks, such as memory. Volatile media include dynamic random access memory (DRAM), which typically constitutes the main memory. Transmission media include coaxial cables, copper wire and fiber optics, including the wires that comprise a system bus coupled to the processor. Transmission media may carry acoustic or light waves, such as those generated during radio frequency (RF) and infrared (IR) data communications. Common forms of computer-readable media include, for example, a floppy disk, a flexible disk, hard disk, magnetic tape, any other magnetic medium, a CD-ROM, DVD, any other optical medium, punch cards, paper tape, any other physical medium with patterns of holes, a RAM, a PROM, an EPROM or EEPROM (electronically erasable programmable read-only memory), a FLASH-EEPROM, any other memory chip or cartridge, a carrier wave as described hereinafter, or any other medium from which a computer can read.

Various forms of computer readable media and memories may be involved in carrying one or more sequences of one or more instructions to the processor (or any other processor of a device described herein) for execution. For example, the instructions may initially be borne on a magnetic disk of a remote computer. The remote computer can load the instructions into its dynamic memory and send the instructions over a telephone line using a modem. A modem local to a gaming device (or, e.g., a server) can receive the data on the telephone line and use an infrared transmitter to convert the data to an infrared signal. An infrared detector can receive the data carried in the infrared signal and place the data on a system bus for the processor. The system bus carries the data to main memory, from which the processor retrieves and executes the instructions. The instructions received by main memory may optionally be stored in memory either before or after execution by the processor. In addition, instructions may be received via a communication port as electrical, electromagnetic or optical signals, which are exemplary forms of carrier waves that carry data streams representing various types of information. Thus, the gaming device may obtain instructions in the form of a carrier wave.

According to an embodiment of the present disclosure, the instructions of the program may be read into a main memory from another computer-readable medium, such from a ROM. Execution of sequences of the instructions in program causes processor perform the process steps described herein. In alternate embodiments, hard-wired circuitry may be used in place of, or in combination with, software instructions for implementation of the processes of the present disclosure. Thus, embodiments of the present disclosure are not limited to any specific combination of hardware and software. As discussed with respect to aforementioned systems, execution of sequences of the instructions in a program of a peripheral device in communication with the gaming device may also cause the processor to perform some of the process steps described herein.

The memory may store one or more databases described herein. Some or all of the data stored in each database is also described. The described entries of the databases represent exemplary information only; those skilled in the art will understand that the number and content of the entries can be different from those illustrated herein. Further, despite any description of the databases as tables, an object-based model could be used to store and manipulate the data types of the present disclosure and likewise, object methods or behaviors can be used to implement the processes of the present disclosure.

Where appropriate, a prior art probability database may be utilized in the performance of the inventive processes described herein. A probability database may be stored in the data storage device in tabular form, or any other appropriate database form, as is well known in the art. The data stored therein may include a number of exemplary records or entries, each defining a random number. Those skilled in the art will understand that the probability database may include any number of entries. The tabular representation may also define fields for each of the entries or records. The fields may specify: (i) a random number (or range of random numbers) that may be generated by the random number generator; and (ii) an outcome that indicates the one or more indicia comprising the outcome that corresponds to the random number of a particular record. A gaming device may utilize a probability database to determine, for example, what outcome corresponds to a random number generated by a random number generator and to display the determined outcome. The outcomes may comprise the cards drawn to form individual blackjack, baccarat or other card game hands. The cards may be determined in advance, as they are being dealt (regardless of whether they are dealt face up or face down), as they are exposed, etc. Other arrangements of probability databases are also possible. For example, the book "Winning At Slot Machines" by Jim Regan (Carol Publishing Group Edition, 1997) illustrate examples of payout and probability tables and how they may be derived. The entirety of this book is incorporated by reference herein for all purposes.

Further, where appropriate, a prior art payout database may be utilized in the performance of the one or more of the processes described herein. A payout database may be stored in the data storage device in tabular form, or any other appropriate database form, as is well known in the art. The data stored therein includes a number of example records or entries, each defining an outcome that may be obtained on a gaming device that corresponds to a payout. Those skilled in the art will understand that the payout database may include any number of entries. The tabular representation also defines fields for each of the entries or records. The fields specify: (i) an outcome, which indicates the one or more indicia comprising a given outcome; and (ii) a payout that corresponds to each respective outcome. The outcomes may be those obtained on a video blackjack or baccarat machine, for example.

A gaming device may utilize the payout database to determine whether a payout should be output to a player as a result of an outcome obtained for a game. For example, after determining the outcome to output on the gaming device, the gaming device may access the payout database to determine whether the outcome for output is one of the outcomes stored as corresponding to a payout. If it is, the gaming device may provide the corresponding payout to the player.

Other arrangements of payout databases are possible. For example, the book "Winning At Slot Machines" by Jim Regan (Carol Publishing Group Edition, 1997) illustrate many examples of payout and probability tables and how they may be derived.

Additionally, where appropriate, a player database may be utilized to store historical data associated with specific players. A player database may be used, for example, to store player wager data so that players wagering over a given threshold in a given amount of time may be rewarded for their patronage. The player database may also contain other information that may be useful in, for example, promoting and managing player behaviors (e.g., information about the player's gaming preferences, gaming sessions, outstanding debts, lodging arrangements, and the like). Further, the player database may store data regarding a given player's standing in a game session or bonus game, so that the player can continue the game session or bonus game at a plurality of game machines that have common access to the player database. Such player data may be stored in a relational database and retrieved or otherwise accessed by the processor after receiving a "key" data point from the player, such as a unique identifier read from the player's player tracking card or cashless gaming ticket, PIN or code entered by a player using an input device of a gaming device, and so on.

Note that, although these databases may be described as being stored in a gaming device, in other embodiments of the present disclosure some or all of these databases may be partially or wholly stored in another device, such as one or more of the peripheral devices, the peripheral device server, central server, kiosks, casino personnel devices, merchant POS terminals, and so on. Further, some or all of the data described as being stored in the databases may be partially or wholly stored (in addition to or in lieu of being stored in the memory of the gaming device) in a memory of one or more other devices, such as one or more of the peripheral devices, another gaming device, the peripheral device server and/or the server.

In one embodiment, gaming device may be operable to facilitate downloadable games such that games available for play on the gaming device may be stored on a server device (e.g., a server or another dedicated device) and downloaded to the gaming device. In one embodiment, software components of the gaming device may be remotely modified and/or updated by another device (e.g., a server or another device). For example, a payout or probability table stored in the memory of gaming device may be altered, modified or updated remotely, hot fixes may be applied to software stored by the gaming device and/or new versions of software may be downloaded to the gaming device. Similarly, the gaming device may be programmed to retrieve any or all such updates from another device, as appropriate and preferred. Any of the above (e.g., downloading of a game, updating of software, modification of a payout or probability table) may occur, for example, based upon an occurrence of an event (e.g., a scheduled event), an indication being received from qualified casino personnel or other personnel (e.g., a regulator), and/or upon a request from a player. In one embodiment, a gaming device may comprise a thin client device controlled by a server device (e.g., a server or another dedicated device such as the peripheral device server).

Where appropriate, a gaming device may also include an alternate, secondary game screen, for outputting information (e.g., payout information, outcome information, etc.) to a player. The secondary game screen may be utilized, for example, to inform a player of the player's standing in a game. The gaming device may be capable of altering display and audio content as described herein (e.g., superimposing graphics over digital displays; a mask layer between physical reels and a player that shades or otherwise alters their appearance).

Figure 3A:
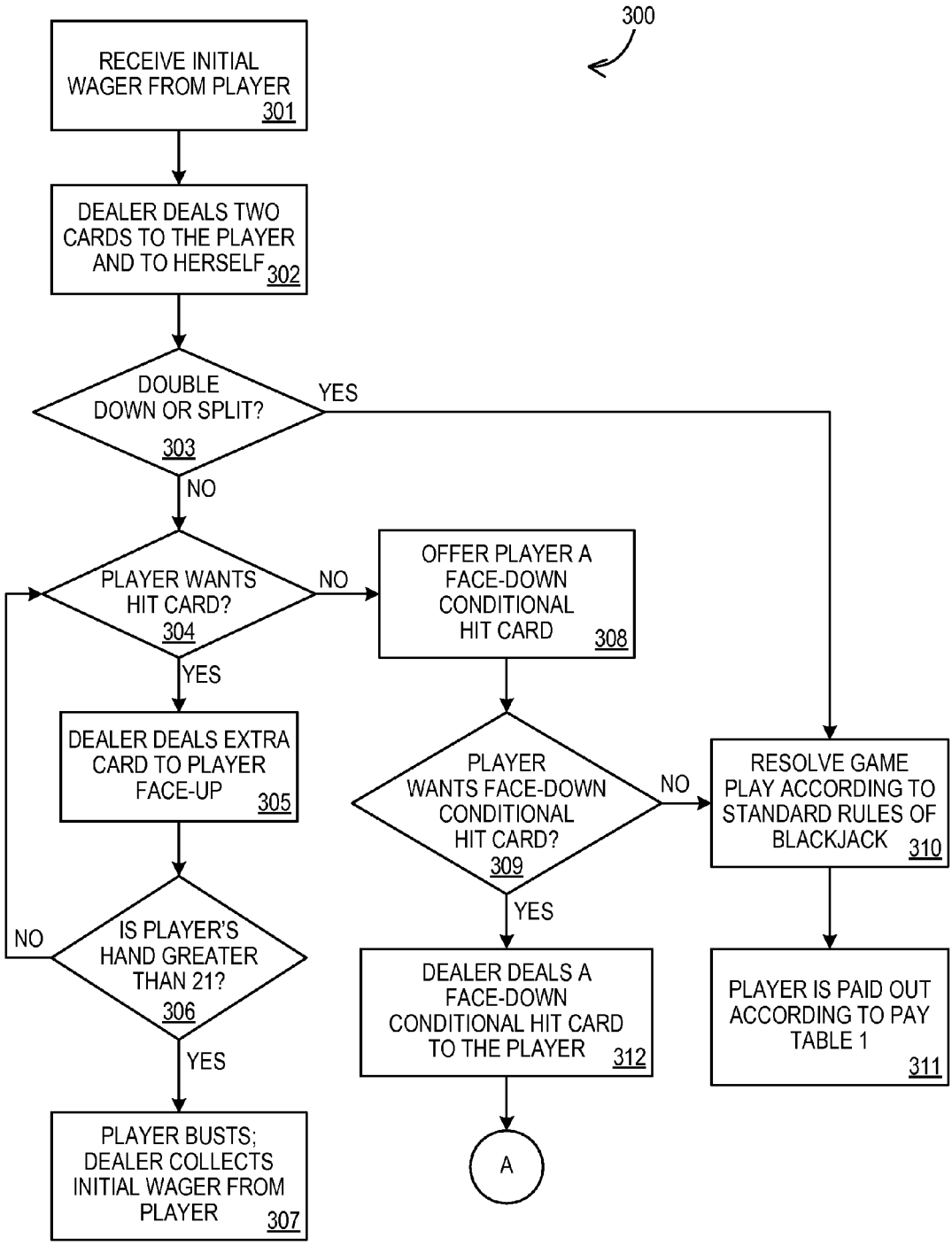
FIGS. 3*a*-3*b* illustrate a flow chart of a wagering process according to one or more embodiments.
Figure 3B:
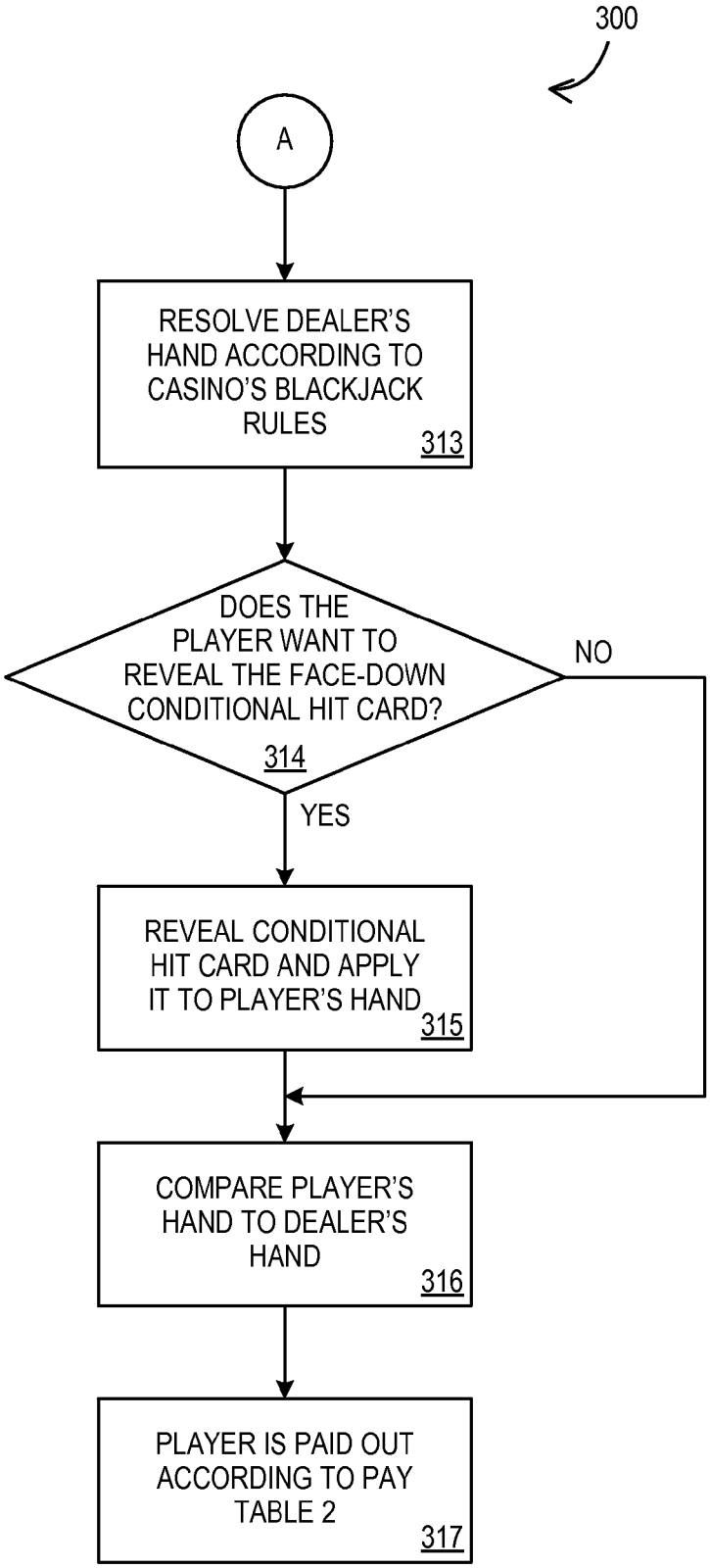

FIGS. 3*a*-3*b* illustrate a flow chart of a wagering process according to one or more embodiments.

In the embodiment described by FIGS. 3*a* and 3*b*, payouts are determined based on whether the player accepts a face-down CHC prior to the dealer exposing his downcard. If the Player does not accept a CHC, payouts are determined according to Table 1:

TABLE 1

No fee for using conditional hit card
Payout table: Standard play (without conditional hit cards)

| Event | Payout |
|---|---|
| Player wins | |
| w/ blackjack | 3 to 2 |
| w/out using conditional hit card | 1 to 1 |
| Player ties | push |
| Player loses | lose wager |

If the player accepts a CHC, payouts are determined according to Table 2:

TABLE 2

No fee for using conditional hit card
Payout table: When face-down conditional hit card dealt to player

| Event | Payout |
|---|---|
| Player wins | |
| w/ blackjack | 3 to 2 |
| w/out using conditional hit card | 1 to 1 |
| using conditional hit card | 1 to 2 |
| Player ties | lose wager |
| Player loses | lose wager |

In FIG. 3*a*, the first step in the process 300 is receiving an initial wager from the player 301. The dealer deals two cards to the player and two cards to himself 302. In this embodiment, if the player wants to split or double down 303, the game is resolved according to the standard rules of blackjack 310. If not, the player then decides whether to hit 304; if yes, the dealer deals an additional card face-up 305 and a determination is made whether the player's hand is greater than 21 306. If the hand is greater than 21, the player busts and the player loses the initial wager 307; if the hand is less than 21, the player has another opportunity to request a hit card 304 (if the hand is exactly 21, the process may skip directly to step 310 (not shown)).

If the player does not want another hit card at any point, the player is offered a conditional hit card 308. The player then decides whether to accept the CHC 309. In this embodiment, the pay table changes from Table 1 to Table 2 as soon as the CHC is accepted, regardless of whether the CHC is ever exposed and used. If the player rejects the conditional hit card, the game is resolved according to the standard rules of blackjack 310, and the player is paid according to table 1 based on whether the player wins, loses or pushes 311.

If the player does want a CHC, the dealer deals a CHC face down to the player 312. The process continues in FIG. 3*b*.

Once the face down CHC is dealt, the dealer's hand is resolved according to standard casino blackjack rules 313, i.e., hit on 16 or less, stand on 17 or greater. At this point, the player has the option of revealing the CHC 314. If the player reveals the CHC, it is added to the player's hand 315 and the player's final hand is compared to the dealer's final hand 316; if the CHC is not revealed, the player's intermediate hand becomes a final hand and is compared to the dealer's final hand 316. The player is then paid out according to Table 2 above 317.

Figure 4A:
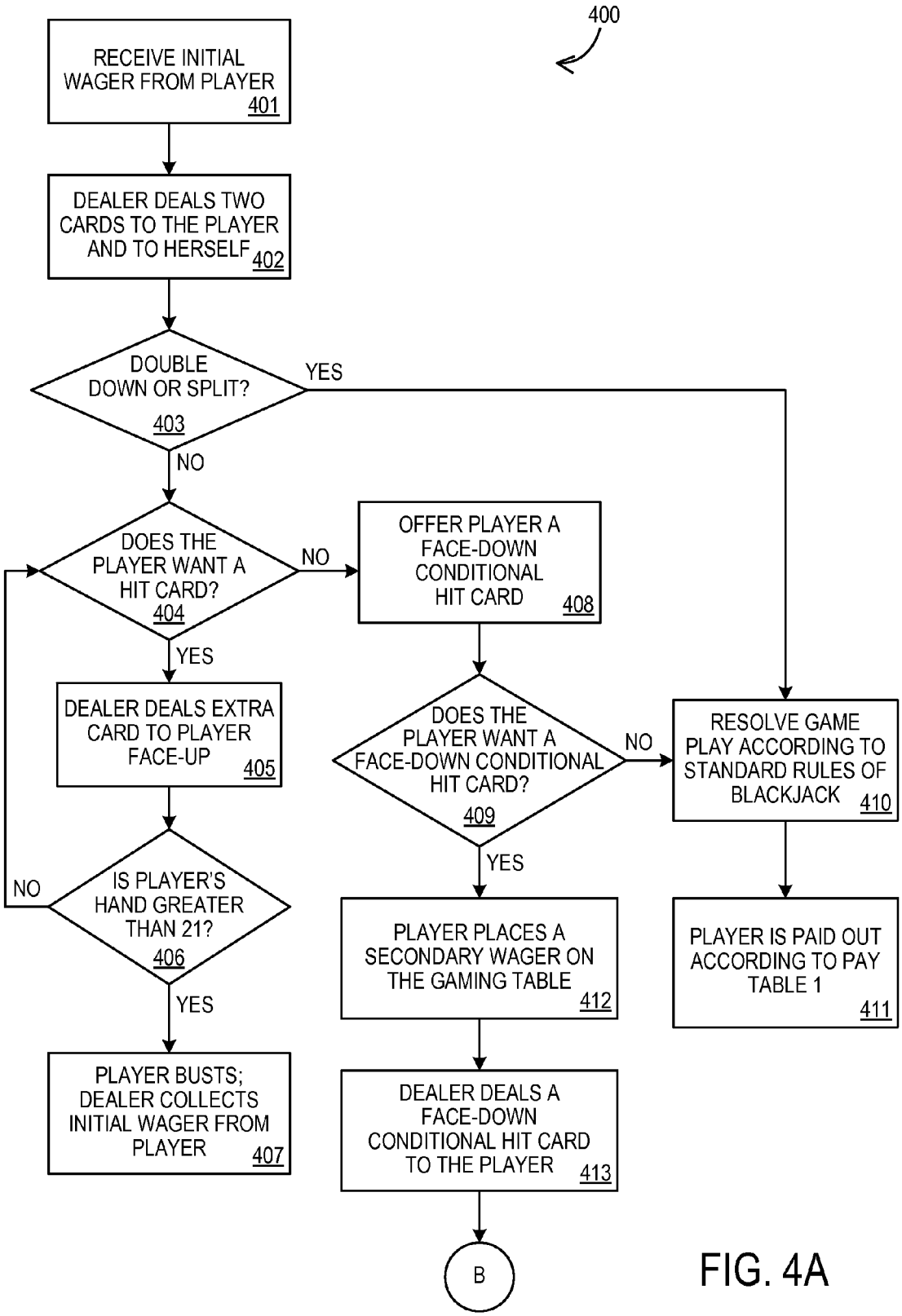
FIGS. 4*a*-4*b* illustrate a flow chart of an alternate wagering process according to one or more embodiments.
Figure 4B:
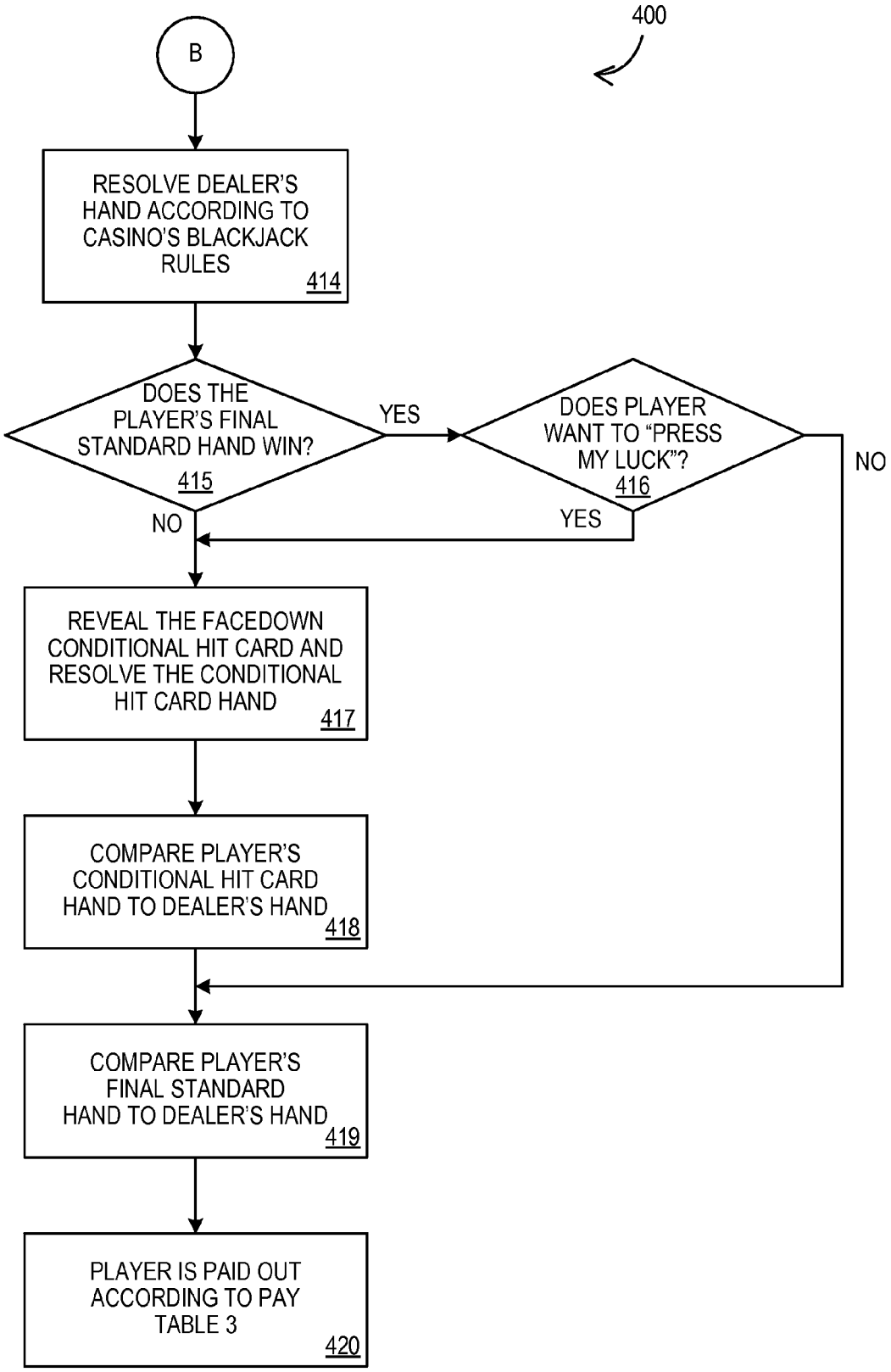

FIGS. 4*a*-4*b* illustrate a flow chart of an alternate wagering process according to one or more embodiments.

Similar to FIG. 3*a*, the first step in the process 400 of FIG. 4*a* is receiving an initial wager from the player 401. The dealer deals two cards to the player and two cards to himself 402. If the player wants to split or double down 403, the game is resolved according to the standard rules of blackjack 410. If not, the player then decides whether to hit 404; if yes, the dealer deals an additional card face-up 405 and a determination is made whether the player's hand is greater than 21 406. If the hand is greater than 21, the player busts and the player loses the initial wager 407; if the hand is less than 21, the player has another opportunity to request a hit card 404 (if the hand is exactly 21, the process may skip directly to step 410 (not shown)).

Once the player stands, i.e., does not want another hit card, the player is offered a conditional hit card 408. The player then decides whether to accept the CHC 409. If the player refuses the CHC, the game is resolved according to the conventional rules of blackjack 410, and the player is paid out 411 according to Table 1, described above.

For the player to receive a CHC in this embodiment, however, the player places a secondary wager 412, and the dealer deals a face-down CHC to the player 413. The process continues in FIG. 4*b*.

The dealer's hand is resolved according to conventional blackjack rules 414, and it is determined whether the player's intermediate hand beats the dealer's hand 415. If the player's intermediate hand does not beat the dealer, the CHC is exposed and activated 417 to establish the player's final hand.

If the player's intermediate hand beats the dealer's hand, the player is given an option to "Press My Luck" 416. If the player elects to "press his luck," the CHC is exposed and activated to establish the player's final hand 417. If the player elects not to "press his luck," the player's intermediate hand becomes the player's final hand and the process skips directly to step 419.

Once the final hand has been established, the final hand is compared to the dealer's final hand 418, and the player is paid out 419 according to Table 3, described below:

TABLE 3

A secondary wager required to receive a conditional hit card
Payout table: When face-down conditional hit card dealt to player

| Event | Initial wager pays | Secondary wager pays |
|---|---|---|
| Player wins | | |
| w/ blackjack | 3 to 2 | N/A |
| w/out using conditional hit card | 1 to 1 | push |
| using conditional hit card to "Save the Day" | lose wager | 1 to 1 |
| first wager & "Press Your Luck" | 1 to 1 | 5 to 1 |
| Player ties | | |
| w/out using conditional hit card | push | push |
| using conditional hit card to "Save the Day" | lose wager | push |
| Player loses | lose wager | lose wager |

Figure 5A:
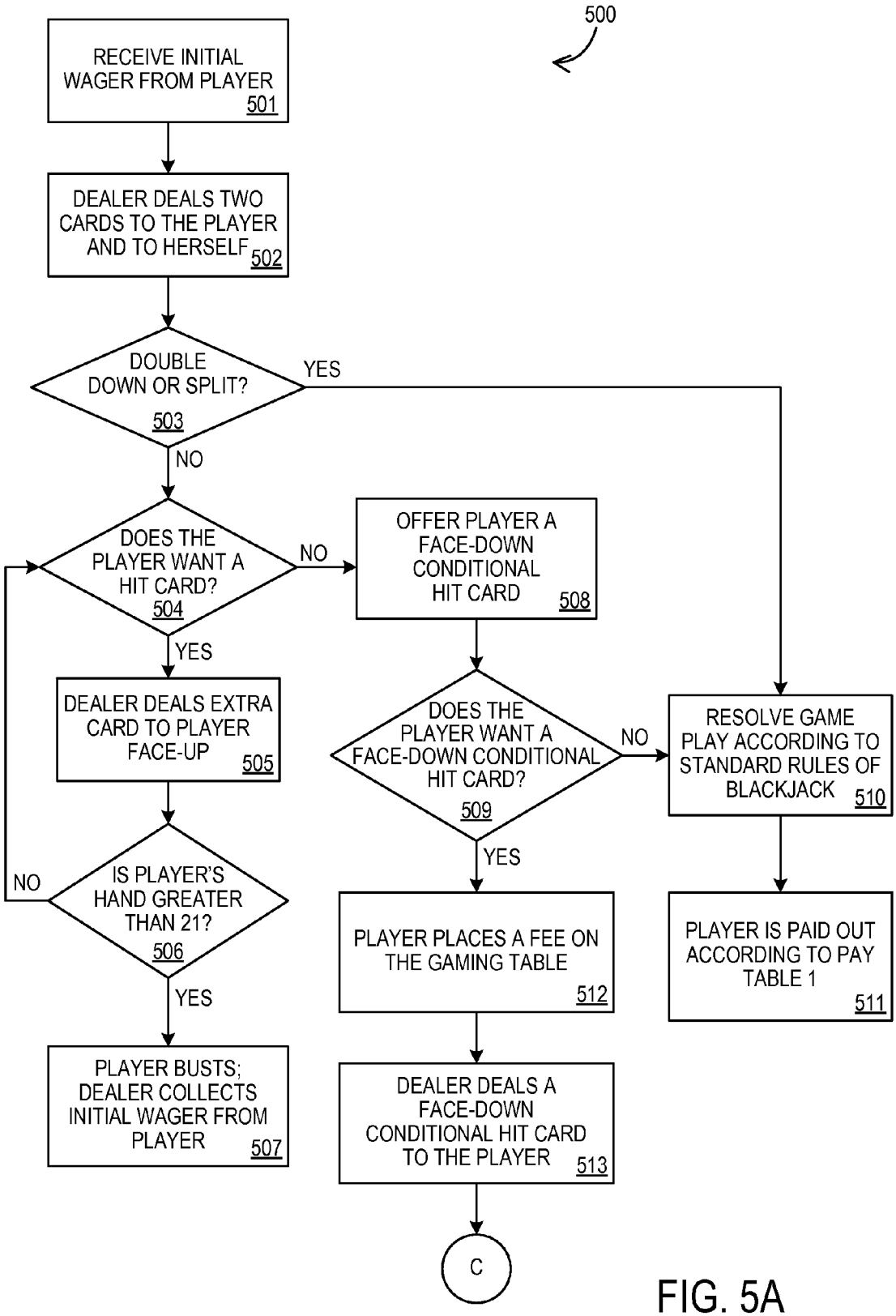
FIGS. 5*a*-5*b* illustrate a flow chart of an alternate wagering process according to one or more embodiments.
Figure 5B:
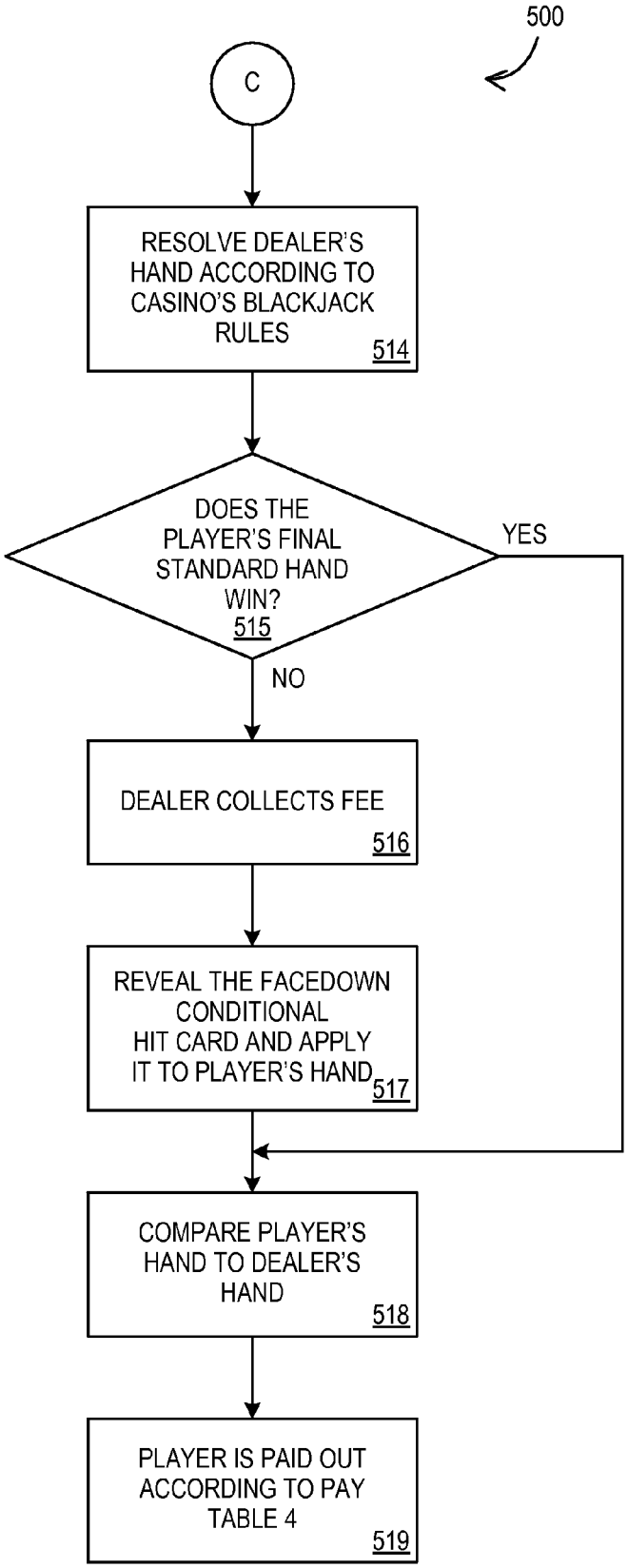

FIGS. 5*a*-5*b* illustrate a flow chart of an alternate wagering process according to one or more embodiments.

Similar to FIG. 4*a*, the first step in the process 500 of FIG. 5*a* is receiving an initial wager from the player 501. The dealer deals two cards to the player and two cards to himself 502. If the player wants to split or double down 503, the game is resolved according to the standard rules of blackjack 510. If not, the player then decides whether to hit 504; if yes, the dealer deals an additional card face-up 505 and a determination is made whether the player's hand is greater than 21 506. If the hand is greater than 21, the player busts and the player loses the initial wager 507; if the hand is less than 21, the player has another opportunity to request a hit card 504 (if the hand is exactly 21, the process may skip directly to step 510 (not shown)).

Once the player stands, i.e., does not want another hit card, the player is offered a conditional hit card 508. The player then decides whether to accept the CHC 509. If the player refuses the CHC, the game is resolved according to the conventional rules of blackjack 510, and the player is paid out 511 according to Table 1, described above.

For the player to receive a CHC in this embodiment, however, the player pays a fee 512, and the dealer deals a face-down CHC to the player 513.

As noted above, embodiments using a fee structure may be fixed, variable or proportional with respect to the initial wager. The legal distinctions between a fee and a secondary wagers are substantial as well, particularly with respect to tax treatment. For example, an initial wager that pays out 1-1 and a secondary wager that also pays out 1-1 has the same net effect as an initial wager that pays out 3-1 and includes a 1 unit fee. If the player wins, he has 2 more units than he started with, and if he loses, he has 2 fewer units, but his taxable winnings for the first example may only be 2 units (the winnings from two 1-1 bets) while the taxable winnings from the second example may be 3 units (the winnings from the initial 3-1 bet. Even if the player is allowed to deduct the 1 unit fee for a net 2 unit win, there are still situations under which the gross 3 unit win in the second example could still trigger IRS reporting requirements while the 2 unit win from the first example might not. The process continues in FIG. 5*b*.

Turning back to the described embodiment, the dealer's hand is resolved according to conventional blackjack rules 514, and it is determined whether the player's intermediate hand beats the dealer's hand 515. If the player's intermediate hand does not beat the dealer, the dealer collects the fee 516 and the CHC is exposed and activated 517 to establish the player's final hand.

If the player's intermediate hand beats the dealer's hand, the player's intermediate hand becomes the player's final hand and the process skips directly to step 518. In this embodiment, the player does not lose his fee if the CHC is not used, but other embodiments contemplate presenting and collecting the fee at other points during play. Once the final hand has been established, the final hand is compared to the dealer's final hand 518, and the player is paid out 519 according to Table 4, described below:

TABLE 4 fee for using conditional hit card
Payout table: When face-down conditional hit card dealt to player

| Event | Fee | Payout |
|---|---|---|
| Player wins | | |
| w/ blackjack | | 3 to 2 |
| w/out using conditional hit card | | 1 to 1 |
| using conditional hit card | $10 | 1 to 2 |
| Player ties | $10 | push |
| Player loses | $10 | lose wager |

Figure 6A:
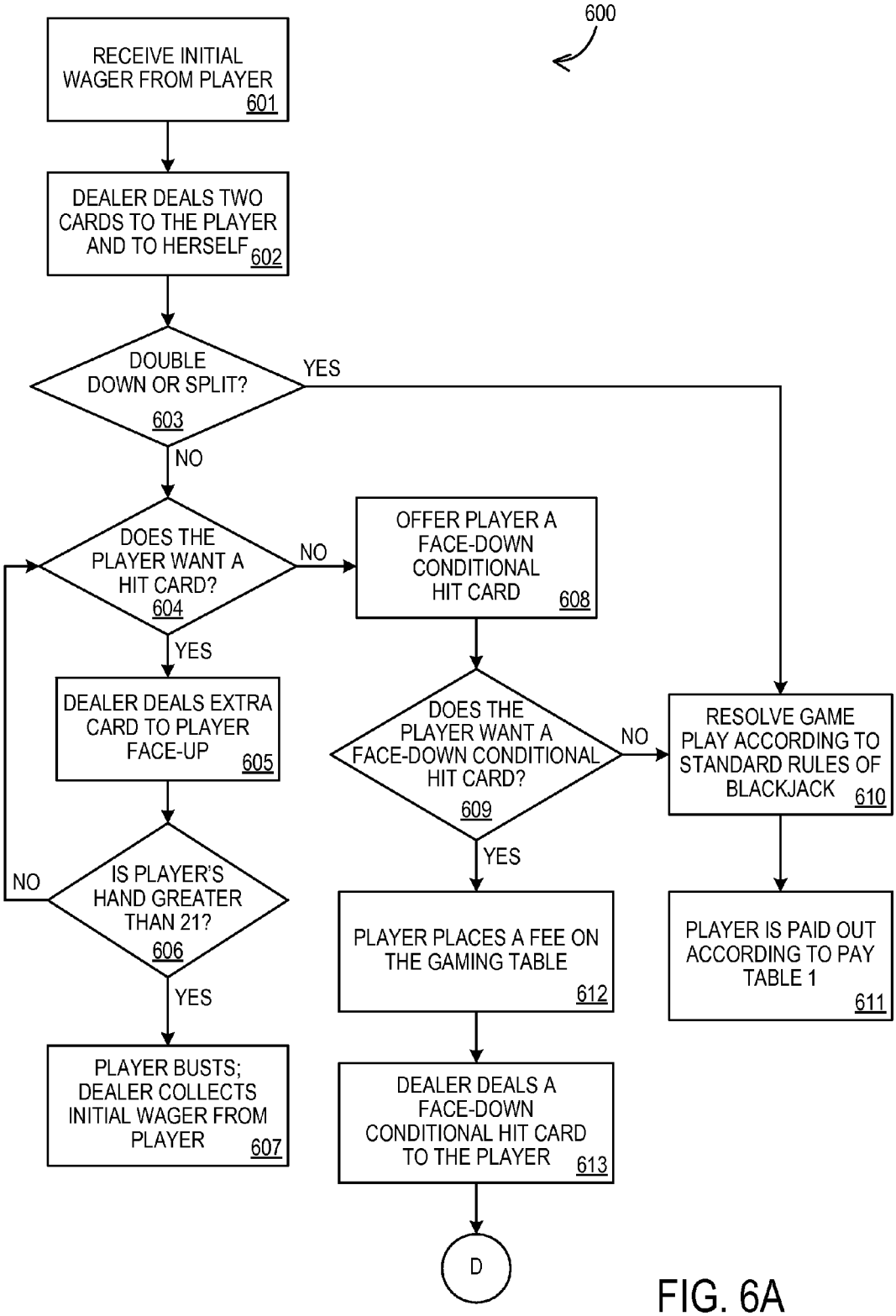
FIGS. 6*a*-6*b* illustrate a flow chart of an alternate wagering process according to one or more embodiments.

Similar to FIG. 6*a*, the first step in the process 600 of FIG. 6*a* is receiving an initial wager from the player 601. The dealer deals two cards to the player and two cards to himself 602. If the player wants to split or double down 603, the game is resolved according to the standard rules of blackjack 610. If not, the player then decides whether to hit 604; if yes, the dealer deals an additional card face-up 605 and a determination is made whether the player's hand is greater than 21 606. If the hand is greater than 21, the player busts and the player loses the initial wager 607; if the hand is less than 21, the player has another opportunity to request a hit card 604 (if the hand is exactly 21, the process may skip directly to step 610 (not shown)).

If the player does not want another hit card at any point, the player is offered a conditional hit card 608. The player then decides whether to accept the CHC 609. If the player refuses the CHC, the game is resolved according to the conventional rules of blackjack 610, and the player is paid out 611 according to Table 1, described above.

Figure 6B:
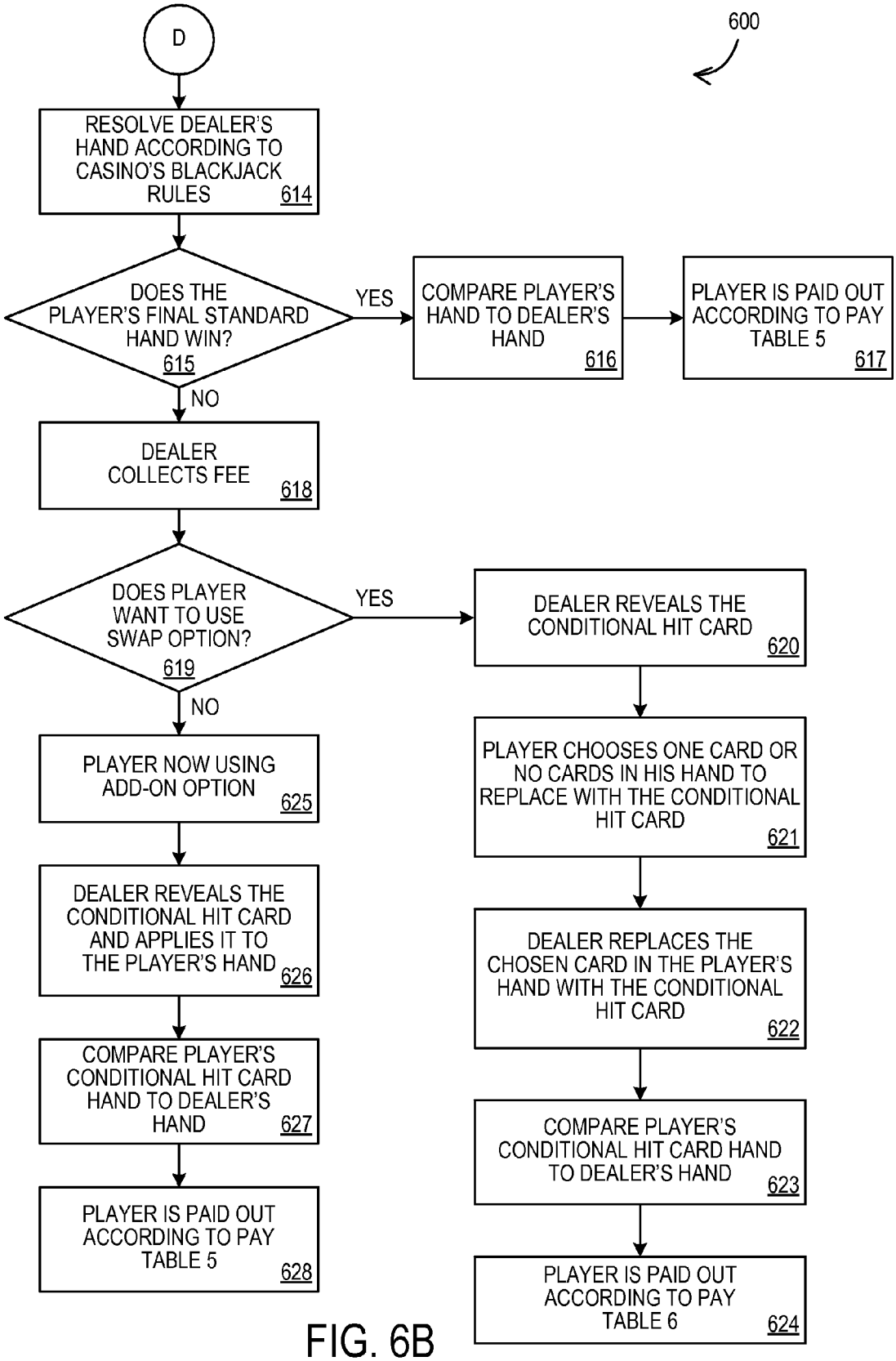

For the player to receive a CHC in this embodiment, however, the player places a secondary wager 612, and the dealer deals a face-down CHC to the player 613. The process continues in FIG. 6*b*.

The dealer's hand is resolved according to conventional blackjack rules 614, and it is determined whether the player's intermediate hand beats the dealer's hand 615.

If the player's intermediate hand beats the dealer's hand, the player's intermediate hand becomes the player's final hand and the player is paid out according to Table 5, described below.

TABLE 5 fee for using conditional hit card
Payout table: Add-On Option when face-down conditional hit card dealt to player

| Event | Fee | Payout |
|---|---|---|
| Player wins | | |
| w/ blackjack | | 3 to 2 |
| w/out using conditional hit card | | 1 to 1 |
| using conditional hit card | $10 | 1 to 1 |
| Player ties | | |
| w/out using conditional hit card | | push |
| using conditional hit card | $10 | push |
| Player loses | $10 | lose wager |

If the player's intermediate hand does not win, the dealer collects a fee from the player 618, and the player chooses whether to use the "add on" or "swap" option 619. If the player declines the "swap" option, i.e., chooses the add-on option 625, the dealer exposes the conditional hit card and adds the card to the player's intermediate hand to establish the player's final hand/CHC hand 626, comparing the player's final hand to the dealer's final hand 627, and paying the player out 628 according to pay table 5.

If the player elects the "swap" option, the dealer exposes the CHC 620 and the player chooses a card in his intermediate hand to replace with the CHC 621 to establish the final hand 622. In some embodiments, the player may choose to not swap any card if the CHC is does not improve his hand, for example, in embodiments where the player still has an opportunity to win the hand using his intermediate hand alone. In other embodiments, the player may be forced to swap, and/or may only be able to swap out certain cards in the intermediate hand, e.g., only one of the first two cards dealt, or only his last dealt card.

Once the final hand has been established using the swap option, the final hand is compared to the dealer's final hand 623, and the player is paid out 624 according to Table 6, described below:

TABLE 6 fee for using a conditional hit card
Payout table: Swap Option when face-down conditional hit card dealt to player

| Event | Fee | Payout |
|---|---|---|
| Player wins | | |
| w/ blackjack | | 3 to 2 |
| w/out using conditional hit card | | 1 to 1 |
| using conditional hit card | $10 | 1 to 2 |
| Player ties | | |
| w/out using conditional hit card | | push |
| using conditional hit card | $10 | push |
| Player loses | $10 | lose wager |

Any number of variations on these embodiments are available, and may be adjusted and optimized for any number of variables. For example, game volatility may be adjusted up or down based on the expected value from optimal play according to variations on these rules and different pay tables. In some embodiments, reducing or even eliminating the house edge may be desirable for the casino, i.e., the game may be a loss leader for other more profitable games nearby. Increasing game volatility can increase the excitement from larger wins and losses, just as decreasing game volatility can attract more reticent gamers that may be hesitant to risk any money otherwise. The variability in these rules allow each operator to fine-tune the edge and volatility of their preferred rule set without causing undue confusion to novice gamers familiar with the rules of blackjack or other card games.

Additional rule variations include presenting the option to take a CHC after the dealer's downcard is revealed, but before the resolution of the dealer's hand. For example, if a dealer's upcard is a six, a player may be reluctant to place a second wager that may reduce his payout, because the dealer is likely to bust. However, if the dealer's downcard is a five, the dealer is much more likely to win, and the player might now be willing to take a CHC. The player may also be presented with multiple opportunities to take a CHC throughout the resolution of the intermediate hand. The pay tables may adjust based on the stage at which the CHC is taken, or a unified pay table could take the entire expected value of these additional opportunities into account.

Figure 7A:
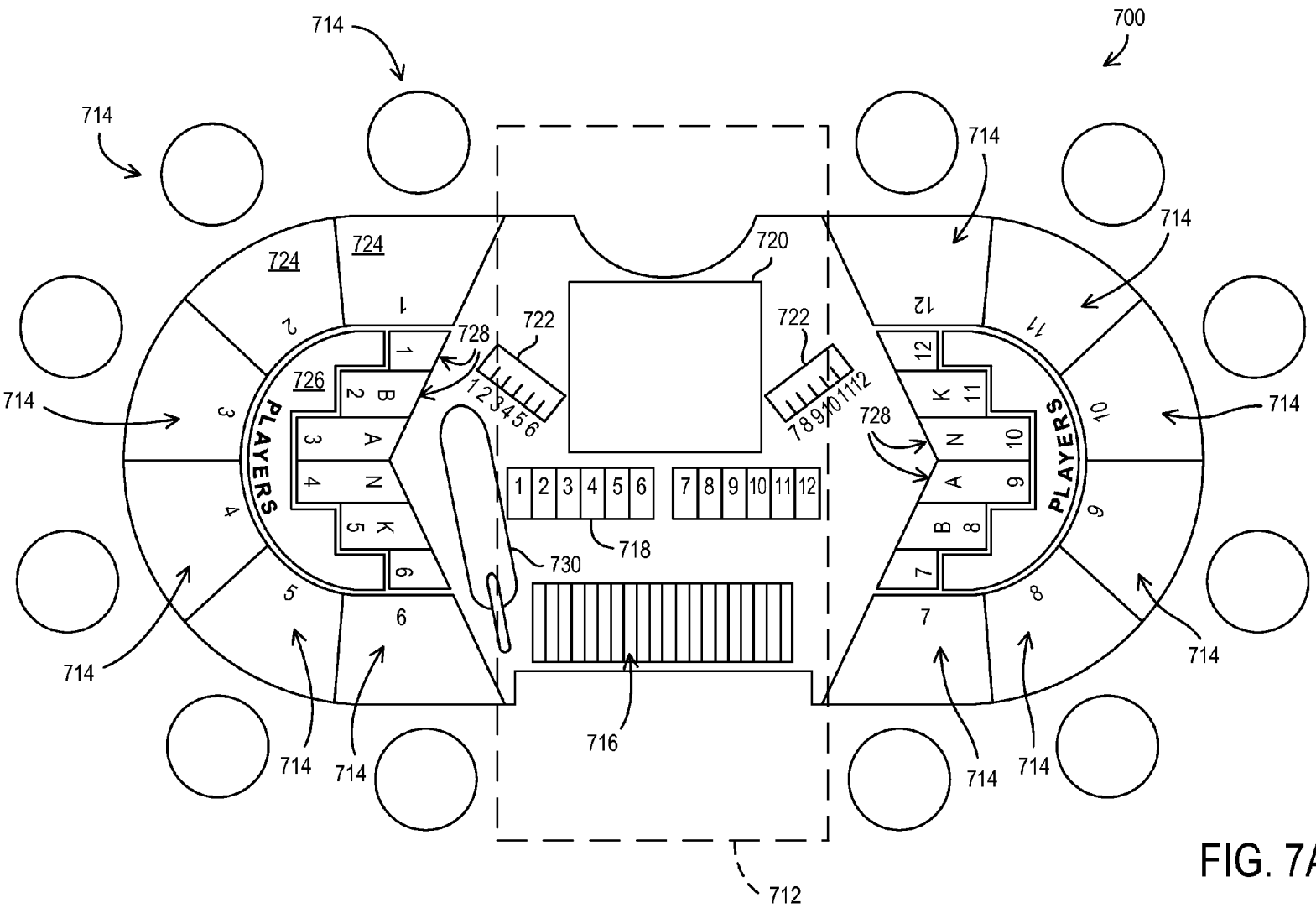
FIGS. 7*a*-7*e* illustrate a baccarat table game according to one or more embodiments.

FIGS. 7*a-e* illustrate a baccarat table game according to one or more embodiments. FIG. 7*a* illustrate a traditional American baccarat table 700 with a dealer station 712 and a plurality of player stations 714 is illustrated. The dealer station 712 is sized to accommodate two dealers, one on either side. Many high roller style baccarat tables actually have three dealers present, and the dealer station 712 may provide room for the number of dealers assigned to the table. The dealer station 712 has a chip rack 716, as well as commission indicia 718, bank and player hand area 720, and tie bet indicia 722. The chip rack 716 is sized to accommodate chips and plaques as is well understood. The commission indicia 718 allow the house to keep a record of any commissions that the player may owe for betting on the banker hand. Players usually settle the commission at the end of the shoe and/or before leaving the table so as to minimize disruption of game play. As illustrated, commission indicia 18 are divided into boxes for each player station. The banker hand area 720 is the place to which the cards forming the banker hand are dealt. The tie bet indicia 722 are the locations on the table where a player may indicate a wager on a tie between the banker hand and the player hand. Again, the tie bet indicia 722 are divided so that there is a box for each player station. While the tie bet indicia 722 may conceptually be thought of as part of the player stations 714, the positioning of the tie bet indicia 722 in the center of the table makes it impractical for a player to position a wager therein, so in most instances, the dealer will position such a wager, and thus, for the purposes of the present disclosure, the tie bet indicia 722 are included within the dealer station 712. While not illustrated in FIG. 7*a*, some baccarat tables have display panels that indicate historical outcomes. Players sometimes use such historical outcomes in an effort to predict trends within a stream of game instances.

Each player station 714 includes a chip area 724 where the player may position her chips. A player bet area 726 exists in front of each chip area 724. As illustrated, the player bet area 726 is not specifically delimited for each player station, but such indicia are sometimes present. Additionally, each player station 714 includes a bank bet area 728 with appropriate indicia to link wagers placed therein to a particular player station 714. The dealers may use a shoe (not shown) to hold cards and a paddle or wand 730 to move cards and/or chips to particular locations on the table 700 as is well understood.

FIG. 7*b-e* illustrate a European baccarat table 700', sharing many features with the American baccarat table 700 of FIG. 7*a*, and both American and European Baccarat variants share a number of common features. A player and banker position are each dealt an initial hand of two cards, which are then added together, with the goal of having the sum that ends with nine (9). Single digit numbered cards are worth face value, aces are worth one, and tens and face cards are worth zero (0). For example, an initial hand having a four (4) and a two (2) would add up to six (6). A six (6) and a jack (0) would also add up to six (6). A nine (9) and a seven (7) would add up to sixteen (16) and is also worth six (6) because sixteen ends with a six. Once the initial hands have been dealt and determined for both player and banker, the player either stands or draws a third card (hits) to form a final standard hand (or intermediate hand), and the banker also either stands or hits to form a final standard/intermediate hand. The highest value (i.e., last digit) wins the hand.

In American Baccarat, the rules regarding whether to stand or hit are predetermined and are not optional. If either the player or banker's initial hand is an eight (8) or nine (9), both must stand. If the player's initial hand is a six (6) or seven (7), the player stands. If the player stands on a six (6) or seven (7), the banker hits if his initial hand is five (5) or less. If the player has five (5) or less, the player hits, and the banker hits according to the following rules:

If the Banker has a zero (0), one (1) or two (2), the Banker hits anytime the Player hits. If the Banker has a three (3), the Banker hits if the Player's third card is any card except an eight (8). If the Banker has a four (4), the Banker hits if the Player's third card is any card from two (2) to seven (7). If the Banker has a five (5), the Banker hits if the Player's third card is any card from four (4) to seven (7). If the Banker has a six (6), the Banker hits if the Player's third card is six (6) or a seven (7). If the Banker has a seven (7), the Banker always stands.

European Baccarat is similar to American Baccarat, but includes several key differences. For example, in American Baccarat, a bettor may bet on either the Player at 1-1 odds or on the Banker at 1-1 odds minus a 5% commission. In European Baccarat, a bettor must always bet on the Player position. In addition, in European Baccarat, the player has the option of hitting or standing on a five (5), and the Banker has the option to hit at any time (but will generally follow the American rules for hitting in many casinos). In both standard variants of Baccarat, a final standard/intermediate hand can only have two or three cards. However, there are many conditional hit card embodiments that can be integrated into both variants, as well as many other card games having a hit card. For a more detailed discussion of the rules of Baccarat and its many variants, the interested reader is directed to <www.wizardofodds.com/baccarat>.

Figure 7B:
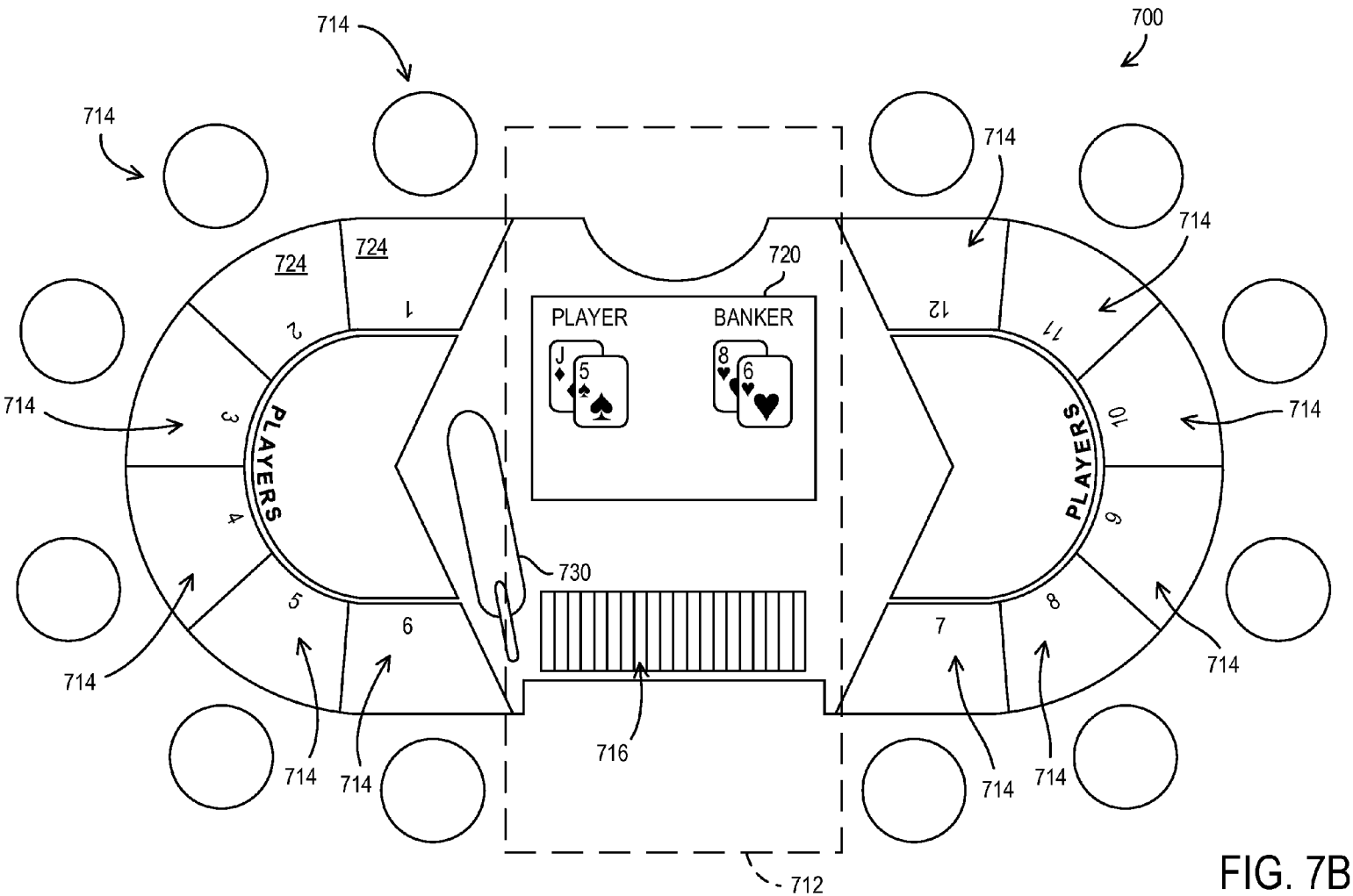
Figure 7C:
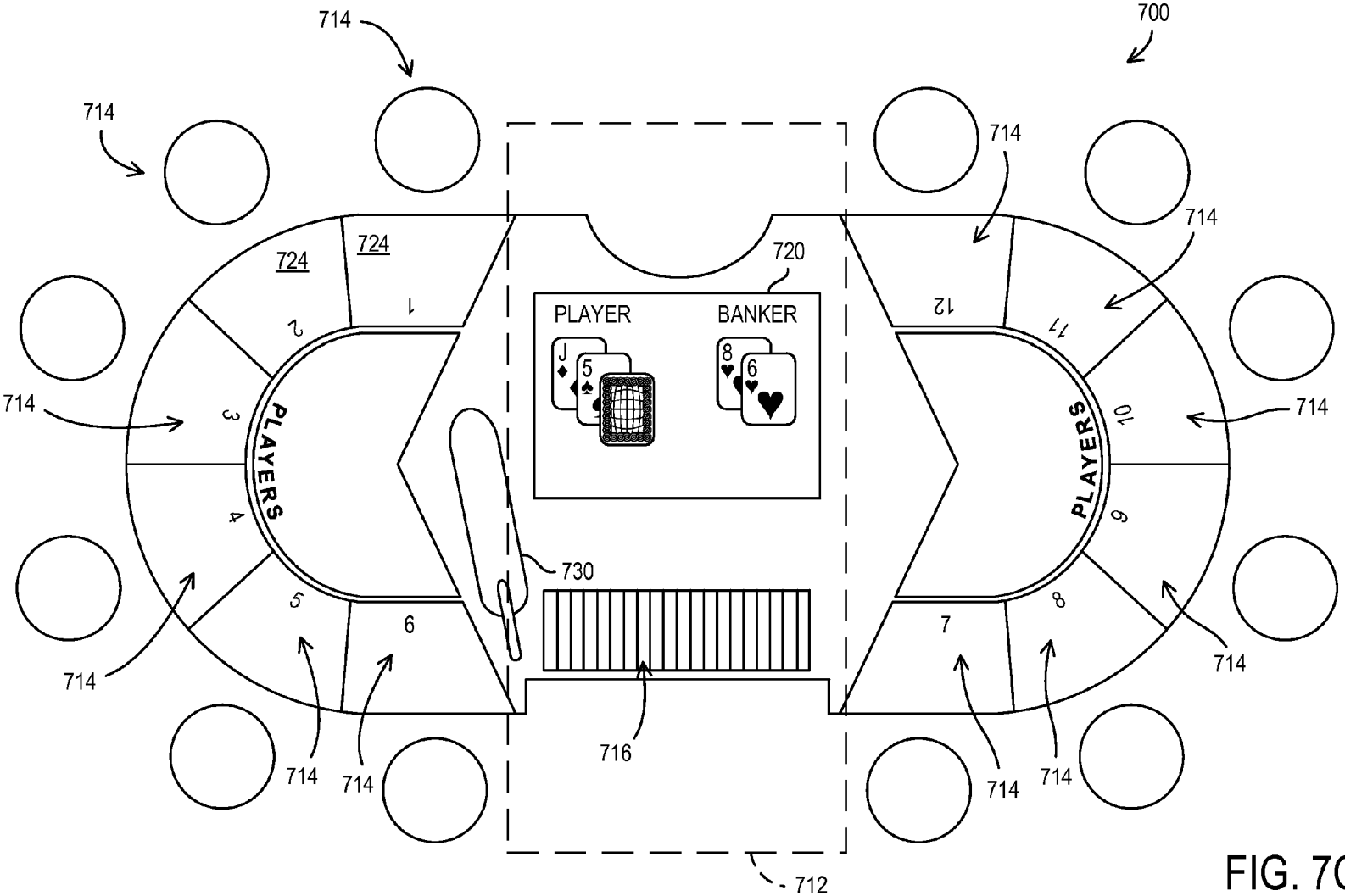
Figure 7D:
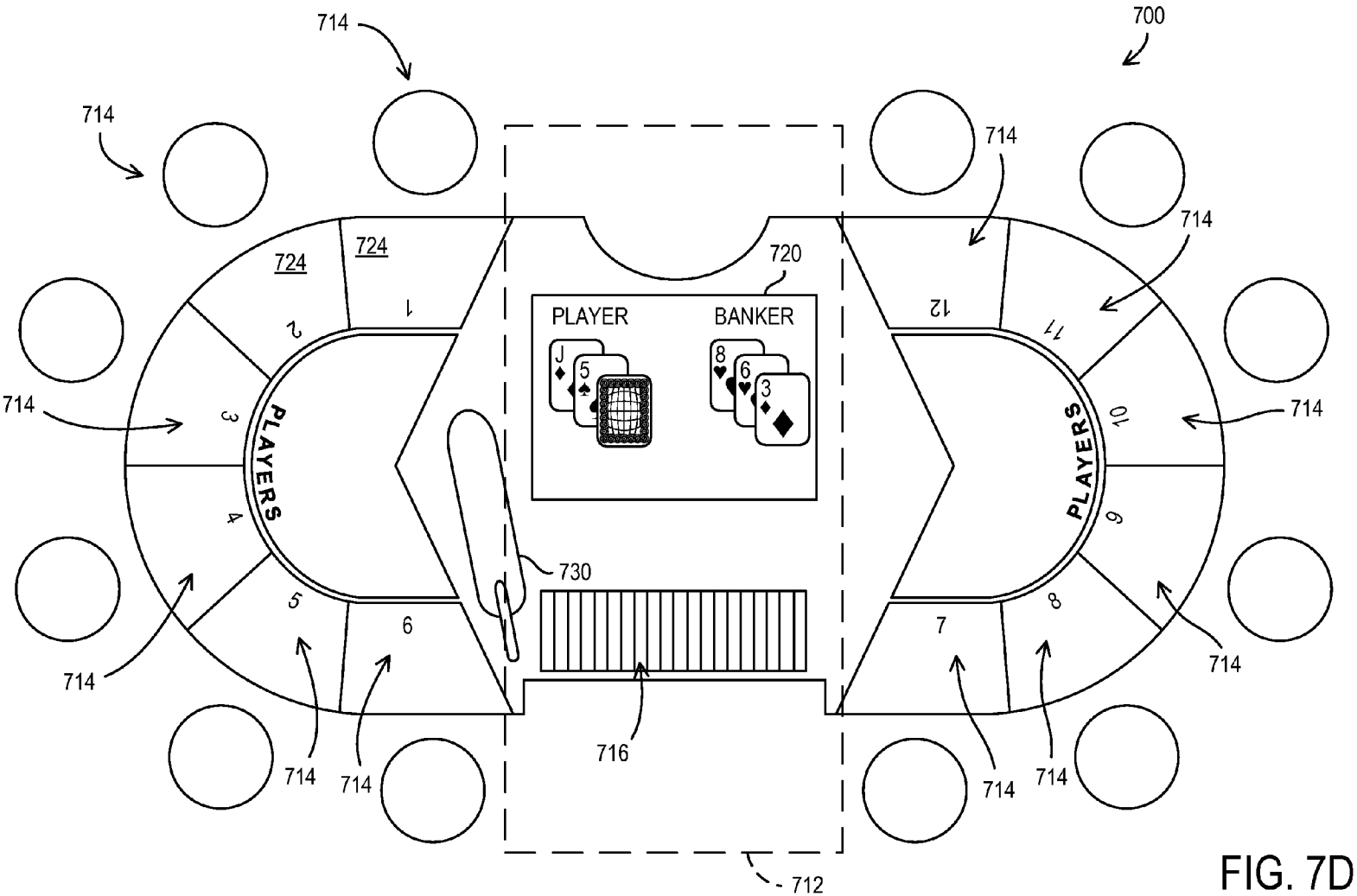
Figure 7E:
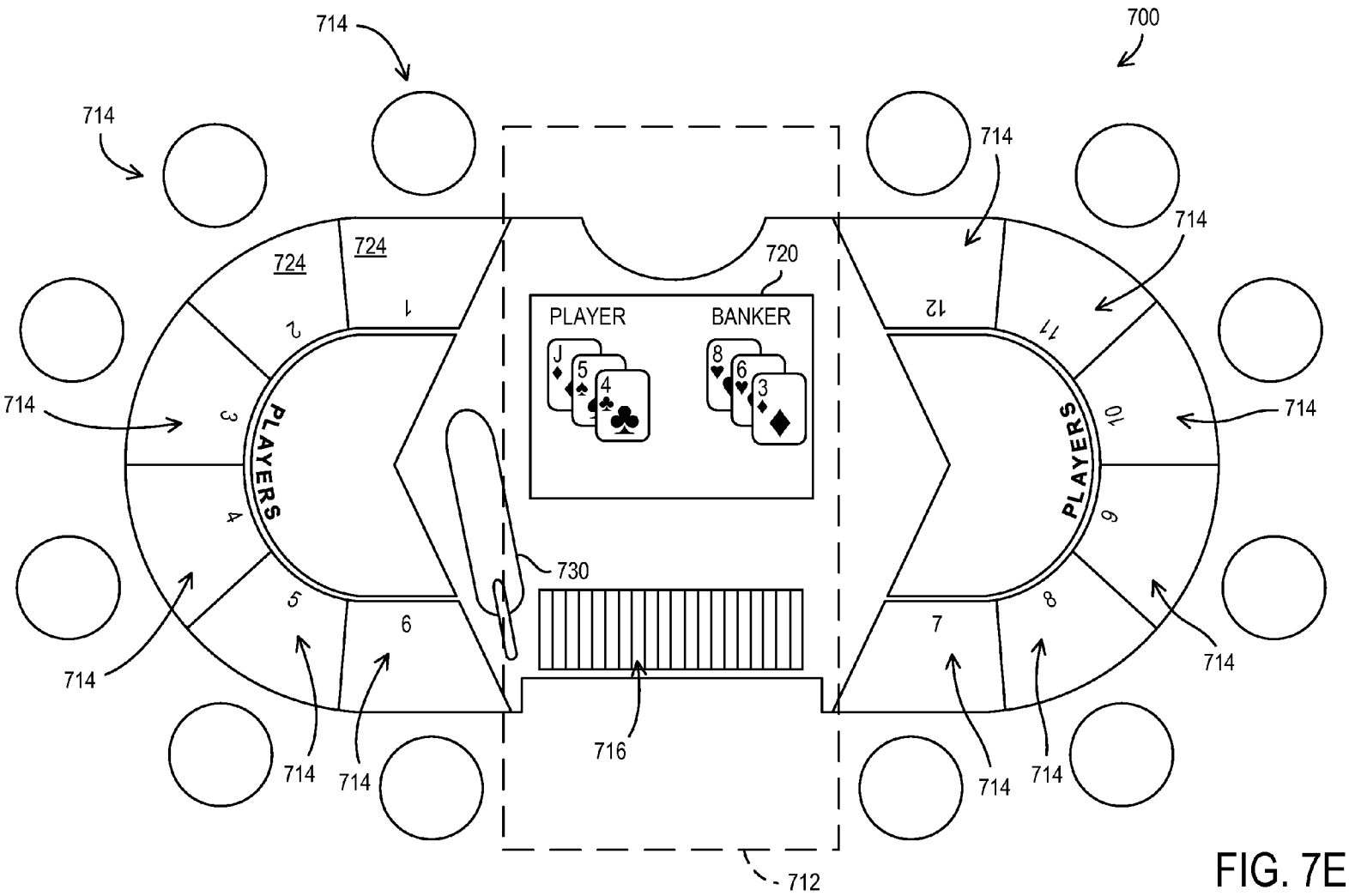

As noted above, FIG. 7*b* illustrate a European Baccarat table 700'. Notably, the European Baccarat table lacks betting positions for the Banker or a commission area (because all bettors bet the Player position 726), and also may lack tie bet indicia in some embodiments. As shown by the example of FIG. 7*b*, the bank and player hand area 720 shows an initial player hand is five (5) and the initial banker hand is four (4). Expecting the banker to hit, the player (bettor) may wish to pay for a conditional hit card, to be used in the event that the banker's final hand is greater than five (5). In FIG. 7*c*, the player at position 1 places a secondary wager (or fee in some embodiments), e.g., on top of or next to his initial wager in player bet area 726, and receives a face-down CHC in banker and player hand area 720. In some embodiments in which multiple players are betting the same cards, the CHC may simply be dealt to the player hand area 720 automatically, with each individual bettor receiving the option to place the secondary wager (or pay a fee). In FIG. 7*d*, the dealer hits, drawing a three (3) for a final hand of seven (7). In FIG. 7*e*, the player then exposes the CHC, revealing a four (4) for a final hand of nine (9) and is paid out according to an appropriate table. As discussed above, the pay tables may be optimized to maintain, increase or decrease the house edge with respect to the house edge on the standard game.

Other embodiments may include allowing a bettor to receive a CHC in American or European Baccarat, regardless of the intermediate hands. For example, a player may want to draw a CHC on a six (6) if the rules require a dealer to hit, i.e., has five (5) or less. A player may also want to draw a CHC as a fourth card, even if he has already hit. It should be understood that many elements of the above described blackjack embodiments may be used in various baccarat embodiments as appropriate, or indeed to any number of other card games.

Some embodiments of the present disclosure utilize a physical gaming table. In some embodiments, such a physical table may comprise various "smart" technologies. Hardware may include: (i) a computing device associated with one or more physical tables (e.g., a "table computer," a "central table server"), (ii) gaming chips (e.g., "smart" gaming chips comprising means for storing data and/or means for communicating with other devices, such as RFID), (iii) playing cards (e.g., radio frequency identification-enabled cards that may identify themselves to a reader device, or cards that are marked to enable identification by an optical reader), (iv) output devices associated with a table (e.g., LED or LCD displays incorporated into the table), (v) input devices to be utilized by players and/or dealers (e.g., physical buttons, a touch-screen, a bill/ticket validator, etc.), and/or (vi) sensors or other devices for wirelessly communicating with objects such as cards and chips (e.g., optical readers or RFID receivers commonly associated with table areas such as betting circles, card shoes, chip trays and the like; U.S. patent Ser. No. 11/672,301 to MILLER, ET AL. provides an example of an RFID-enabled chip tray). Each of these technologies will now be described in some detail.

The control system for this table may be distributed amongst the various components of the table. That is, for example, each dealer station and player station may have its own processor that controls operation of sensors, displays and other input/output mechanisms for each station. Alternatively, a central table control system may be used which controls all the elements of the table. The central table control system may be located proximate the table (e.g., underneath the table or beside the table) or remotely therefrom such as might be the case for a casino controller. In short, the control system for the table may be unitary or distributed, local or remote.

Some embodiments of the present disclosure may be configured to work in a network environment including a computer (e.g., a table computer) that may communicate, via a communications network, with one or more other devices, such as other computing devices (e.g., other table computers), servers (e.g., a central table server, a server for storing player data), components of a table (e.g., output devices, input devices, sensors), smart playing cards, smart betting chips, electronic gaming devices (e.g., video blackjack machines, video baccarat machines) and the like.

The computer may communicate with the devices directly or indirectly, via any appropriate communications means or combination of communications means. Each of the devices may comprise computers, such as those based on the Intel® Pentium® processor, that are adapted to communicate with the computer. Any number and type of devices may be in communication with the computer. Some, but not all, possible communication networks that may comprise the network or be otherwise part of the system include: a local area network (LAN), a wide area network (WAN), the Internet, a telephone line, a cable line, a radio channel, an optical communications line, and a satellite communications link. A variety of communications protocols may be part of the system, including but not limited to: Ethernet (or IEEE 802.3), SAP, SAS™, SuperSAS™, ATP, Bluetooth™, TCP/IP, GSM, GPRS, EDGE, GPS, or WiFi.

In some embodiments, such a computer may comprise a program for executing steps of the present disclosure (e.g., instructing output devices to display session data). A memory (e.g., ROM, RAM) of such a computer may store such a program, as well as maintain or otherwise communicate with one or more databases (e.g., for storing data regarding flat rate sessions). Further, such a computing device may comprise a communications port for communicating with other devices (e.g., an Ethernet port), input devices (e.g., a keyboard, a mouse), output devices (e.g., a CRT monitor), and the like.

Table computers and/or central table servers may be networked in a variety of manners as would be practical for a given casino floor or group of games. In one example, each table in a group of tables may be associated with a table computer, with a central table server being responsible for sending/receiving data from the group (e.g., player data used for loyalty programs may be transmit from a table computer to a central table server, while each table computer may governs actions associated with a particular table). In another example, each player position at a table may be associated with a table computer (e.g., a blackjack table with five player positions features five table computers). For example, each baccarat player may receive the same player hand at their respective table computers, but those who elect to receive a conditional hit card may each receive a different face down CHC.

Applicants' co-pending, provisionally filed Application No. 60/826,977 describes various embodiments of smart gaming chips; specifically, Section 2.1 ("Gaming Chips") of this document offers various technologies that may be utilized for purposes of embodiments described herein. For example, Section 2.1 describes various embodiments of chip casings, displays, wireless transceivers, power sources, memory, input devices and output devices that may be useful in the context of this invention. This application is hereby incorporated by reference for all purposes. Alternatively, or in addition, gaming chips and other objects near a gaming table may be tracked using a camera system (i.e., optically), such as the one described in U.S. Patent Application No. 2005/0026680 to Gururajan, the entirety of which is herein incorporated by reference for all purposes. Note that such a camera system may not require the use of RFID-enabled gaming chips. In one embodiment, gaming chips may be marked to enable easy identification by cameras. Further information about RFID chips can be found in U.S. Pat. Nos. 5,166,502; 5,676,376; 6,021,949; and 6,296,190, which are all incorporated by reference herein. Gaming Partners International™ (GPI™) of 1182 Industrial Rod, Las Vegas, Nev. 89102 and Shufflemaster™ Inc. of 1106 Palms Airport Drive, Las Vegas Nev. 89119 both sell RFID chips suitable for use with the present disclosure although neither product is specifically required to practice embodiments set forth herein. The chips may be interrogated through RF interrogators such as those sold by GPI™ or those described in U.S. Pat. Nos. 4,1814,589; 5,283,422; 5,367,148; 5,651,548; and 5,735,742, all of which are incorporated by reference. Another interrogator is the TAG-IT™ product line produced by Texas Instruments™. An improved interrogator is discussed in U.S. Patent Publication 2006/0077036, which is incorporated by reference. For example, special RFID chips or betting areas may indicate that a player wishes to receive a CHC.

In some embodiments of the present disclosure, playing cards may communicate with other devices. For example, a playing card may wirelessly identify itself to a reader device by transmitting an identifier via radio-frequency identification to one or more RFID reader devices associated with a table (e.g., embedded within a card shoe, underneath a felt surface, etc.). Other known methods and technologies for reading data from playing cards are contemplated (e.g., optically scanning card markings). For example, by tracking dealt cards, including conditional hit cards, proper payouts for a large number of players may be tracked and distributed. One method for reading data from playing cards at table game is taught by German Patent Application No. P44 39 502.7, the entirety of which is herein incorporated by reference for all purposes. Other methods are taught by U.S. Patent Application No. 2007/0052167 to Galatan and U.S. Patent Application No. 2004/0207156 to Soltys, the entirety of which are herein incorporated by reference for all purposes.

Another example of technology for tracking playing cards at table games is the iShoe™ Intelligent Shoe, manufactured by ShuffeMaster Incorporated™. This intelligent shoe reads the rank and suit of each card being dealt, and can transmit game results to a separate device (e.g., table computer) via a casino network. Exemplary intelligent shoes are the IS-T1 and IS-B1 sold by Shufflemaster. Further information is available at the Internet address: www.shufflemaster.com/02_eu_products/utility_products/its/intelligent_shoe_B1.asp, and in U.S. Pat. Nos. 5,941,769 and 7,029,009 and U.S. Patent Publications 2005/002681; 2001/7862227; 2005/0051955; 2005/0113166; 2005/0219200; and 2005/0062226 all of which are incorporated in their entireties.

The present disclosure contemplates utilizing various input and/or output devices (e.g., touch-sensitive screens, CRT screens, LEDs, etc.) embedded within and/or otherwise associated with a gaming table for purposes of (i) outputting information to players and/or dealers (e.g., data is output to players and/or dealers via one or more small display screens) and/or (ii) receiving input from players and/or dealers (e.g., a player requests that he'd like to perform a game-related activity; a dealer authorizes a payout to a player). Various technology described in the following patents and patent applications may be helpful in enabling such inventive embodiments: 2006/0205472 to Sines et al. (touch-screen displays allowing player/dealer input at table games); 2006/0014577 to Snow (player-specific push buttons and display screens in communication with a table game computer); and U.S. Pat. No. 5,779,546 to Meissner et al. (outputting instructions to a dealer via a display screen); these documents are hereby incorporated by reference for all purposes.

In one embodiment, a player may use a wireless electronic device (sometimes referred to herein as a mobile terminal, e.g., a Personal Digital Assistant (PDA), tablet computer, pager, and/or a cell phone) to provide one or more indications or receive and view data related to gaming. That is, the wireless electronic device may provide a substitute for a player terminal at a gaming table. For example, a player may place the wireless electronic device on the gaming table during game play.

In some embodiments, a gaming table may be configured such that each "player position" (e.g., each of six "seats" at a blackjack table) may be associated with (i) one or more betting circles for indicating a bets with physical chips or tokens, (ii) a display device (e.g., an embedded LCD screen for outputting session data), (iii) one or more input devices (e.g., physical buttons, a touch-screen, etc.), (iv) means for receiving/outputting payment (e.g., a multi-purpose "TITO"/bill validating device, such as a FutureLogic GEN2™ PSA-66 device configured to operate within an EZ-Pay™ system of IGT™ Of Reno, Nev.), and/or (v) means for identifying players (e.g., systems for identifying and tracking players at table games via player tracking card readers, as taught in U.S. Pat. No. 5,586,936 to Bennett et al; this patent is hereby incorporated by reference for all purposes).

Applicants' co-pending Application No. 60/826,977 (previously incorporated by reference) features description of sensors, cameras or technologies for wirelessly (e.g., optically or via RFID) reading data from and/or otherwise communicating with objects such as smart playing cards and smart chips. Specifically, Section 2.2 ("Game Table and System") describes various embodiments using a wireless transceiver (e.g., for wireless communication with betting chips). For example, an RFID reader embedded within a betting circle or card shoe may operate to activate a passive transponder associated with a smart betting chip or smart playing card, and thereby read data from it, for example, data relating to a CHC or modified payout. Another method of wirelessly reading values associated with betting chips is taught by U.S. Pat. No. 5,651,548 to French et al.; the entirety of this patent is incorporated by reference of all purposes.

Another example of enabling technology for tracking cards and chips at a gaming table is the Table Management System (TMS™) from Bally™, formerly known as the MindPlay™ system. This system utilizes a specially-designed blackjack tabletop that incorporates specially encoded playing cards, using invisible ink and barcodes, and 14 tiny cameras built into the dealer's chip tray. These cameras can read every card in play by reading the invisible ink printed on them. In addition, the system uses special chips, so that sensors embedded in the table can automatically calculate each player's bet. Other intelligent tables are sold by PGI with Shufflemaster and IGT under the moniker Intelligent Table System (ITS) together with software titled TABLE MANAGER. More information about intelligent tables can be found in U.S. Pat. Nos. 6,676,517; and 7,011,309 as well as U.S. Patent Publications 2002/0147042; 2003/0003997; 2005/0026680; 2005/0026682; and 2005/0054408, all of which are incorporated by reference.

In some embodiments, a multiplayer electronic ("virtual") gaming table may be utilized. Such a device may allow numerous players to partake in rounds of gambling games, without any/all of a live dealer, physical playing cards, or physical wagering chips. Numerous such devices are currently available. For example, Shuffle Master, Inc. of Las Vegas, Nev. manufactures a multiplayer electronic table, marketed as the Table Master™. In some embodiments, memory of a computing device associated with such a table may be loaded with software for executing steps of the present disclosure.

A single-player, standalone electronic gaming device may also be utilized for some embodiments of the present disclosure. For example, IGT™ of Reno, Nev. offers a line of gaming devices known as Game King®, offering numerous different types of games for single-player play, including video blackjack, baccarat and the like. Such software may be repurposed to execute steps of the present disclosure.

As described, in some embodiments, a gaming device may comprise a reader device for reading data from player tracking cards and/or smart cards, such that (i) players may be identified, and (ii) various data associated with players may then be determined (e.g., a number of cashable credits; a number of promotional credits that may not be redeemed for cash; a number of accumulated loyalty points; a number of accumulated game elements such as symbols, cards or hands; etc.). In one example, a card reader device may determine an identifier associated with a player (e.g., by reading a player tracking card comprising an encoded version of the identifier), such that the gaming device may then access data (e.g., of a player database, as described) associated with the player. In another example, a smart card reader device may determine data associated with a player directly by accessing a memory of an inserted smart card.

Thus, as known in the art, "smart cards" may incorporate (i) a memory, and (ii) means for accessing such a memory. For example, in one embodiment, the memory may store data related to aspects of the present disclosure. In one embodiment, data such as tracking wins, losses, CHCs received, CHCs activated, etc., may be written to the smart card as a player plays one or more gaming devices (e.g., such that various data may be updated on a continuous, periodic or event-triggered bases). Accordingly, in one or more embodiments one or more devices operable to carry out various processes of the present disclosure (e.g., a gaming device or kiosk) may have associated therewith a smart card reader device, such that data may be read from the smart card pursuant to the execution of such processes. An example of a smart card system that may be used to implement one or more embodiments of the present disclosure is the s-Choice™ Smart Card Casino Management System from Smart Card Integrators, Inc.™.

Further, as known in the art, a gaming device may comprise a player tracking module comprising (i) a card reader (e.g., a port into which player tracking cards may be inserted), (ii) various input devices (e.g., a keypad, a touch-screen), (iii) various output devices (e.g., a small, full-color display screen), and/or (iv) combinations thereof (e.g., a touch-sensitive display screen that accommodates both input and output functions). Various commercially available devices may be suitable for such an application, such as the NextGen™ interactive player tracking panel manufactured by IGT or the iVIEW display screen manufactured by Bally® Gaming and Systems.

Of course, other non-card-based methods of identifying players are contemplated. For example, a unique identification code may be associated with the player. The player may then be identified upon providing the code. For example, the code may be stored (e.g., within a database maintained within the gaming device and/or a server) such that the player may enter the code using an input device of a gaming device, and accordingly be identified. In other embodiments, player biometrics may serve as identification means (e.g., a player is identified via a thumbprint or retinal scan). In further embodiments, a barcode of a cashless gaming ticket may encode a player identifier.

Thus, as described, various data associated with a player may be tracked and stored (e.g., in an appropriate record of a centrally-maintained database), such that it may be accessed as desired (e.g., when determining promotional offers or rewards to be provided to players, when determining the status of player with respect to a particular game or period of gambling activity, and so on). Further, various statistics may be measured in association with a player (e.g., coin-in statistics, win/loss statistics) and similarly accessed.

Various systems for facilitating such monitoring are contemplated. For example, a two-wire system such as one offered by IGT™ may be used. Similarly, a protocol such as the IGT SAS™ or SuperSAS™ protocol may be used. The SAS™ and SuperSAS™ protocols allow for communication between gaming machines and slot accounting systems and provide a secure method of communicating all necessary data supplied by the gaming device to the online monitoring system. One aspect of the SAS™ and SuperSAS™ protocols that may be beneficial in implementing aspects of the present disclosure, such as preventing fraud relating to embodiments that employ a predetermined face down CHC, are the authentication function which allow operators and regulators to remotely interrogate gaming devices for important memory verification information, for both game programs, and peripheral devices. In another example, a one-wire system such as the OASIS™ System offered by Aristocrat Technologies™ or the SDS slot-floor monitoring system offered by Bally Gaming and Systems™ may be used. Each of the systems described above is an integrated information system that continually monitors slot machines and customer gaming activity. Thus, for example, any one of these systems may be used to monitor a player's gaming activity in order to determine player outcomes, coin-in statistics, win/loss statistics and/or any other data deemed relevant.

In some embodiments, a kiosk may be configured to execute or assist in the execution of various processes of the present disclosure. In some embodiments, a kiosk may comprise a processor and a memory as described. A kiosk may also comprise various input devices (e.g., a keypad, a keyboard, a mouse, buttons, a port that receives player tracking cards, an optical scanner for reading barcodes or other indicia, a CCD camera, etc.), output devices (e.g., a display screen, audio speakers, etc.), benefit output devices (e.g., a coin tray or printer for printing cashless gaming tickets), combinations thereof (e.g., a "ticket-in/ticket-out" device, a touch-sensitive display screen, etc.), communications ports, and so on. Thus, a kiosk may comprise many of the features and components of a gaming device, though the kiosk itself may not necessarily be configured to enable gambling activity as a primary function. A kiosk may communicate with any or all of (i) a central controller, (ii) a gaming device, (iii) an inventory/reservation system of a casino-maintained property (e.g., a hotel), (iv) casino personnel devices, (v) merchant POS terminals, and so on. A number of kiosks may be stationed within casino premises (e.g., at various locations on a slot floor). In various embodiments, kiosks may execute or assist in the execution of (i) determining and outputting a player status or other types of data described herein (e.g., a kiosk receives a player tracking card, and outputs a number of accumulated reward which a player may be entitled to redeem), (ii) outputting payments to players (e.g., upon receipt of cashless gaming tickets, player tracking cards, smart cards, etc.), and/or (iii) any other process described herein. Thus, such a device may be configured to read from and/or write to one or more databases of the present disclosure. The memory of such a device may store a program for executing such processes.

In some embodiments, various casino employees may be equipped with or otherwise utilize one or more casino personnel devices, such as personal digital assistants (PDAs) or other computing devices (e.g., personal computer terminals). A casino personnel device may comprise various input devices (e.g., a keypad, a touch-sensitive display screen, a card reader, an infrared bar code scanner, etc.), various output devices (e.g., an LCD screen), a processor, a memory and/or a communications port, as described herein with respect to other devices. In some embodiments, a casino personnel device may communicate with a gaming device, server, kiosk, peripheral device, and/or an inventory/reservation system of a casino-maintained property (e.g., a hotel). Thus, a casino personnel device may be configurable to, among other things, (i) read from and/or write to one or more databases of the present disclosure, (ii) assist in payments made to players (e.g., a representative "scans" a cashless gaming receipt and determines a value associated with the receipt, and if the receipt is valid, provides payment equal to the value), and/or (iii) execute or assist in the execution of various other processes described herein. The memory of such a device may store a program for executing such processes.

In some embodiments, various merchants (e.g., shops, restaurants, etc.) may utilize point-of-sale (POS) computer terminals to facilitate various processes of the present disclosure. For example, in some embodiments, a player may receive a cashless gaming ticket redeemable for an amount of currency. However, the ticket may alternately or additionally be redeemable for an amount of credit at a particular merchant location. Thus, in some embodiments, merchants may utilize POS terminals to redeem such vouchers. In some embodiments, such devices may be configured to read from and/or write to one or more databases of the present disclosure. Such POS terminals may thus comprise various hardware and software described herein with respect to other devices, and may communicate with (i) a central slot server, (ii) a gaming device, (iii) an inventory/reservation system (e.g., a computer terminal at a theatre communicates with an inventory database to determine a number of unsold seats for a certain event), (iv) a kiosk, and so on.

In some embodiments of the present disclosure, various component devices (e.g., any or all of the benefit output devices, output devices, input devices and/or input output devices described herein) may be embodied as peripheral devices. For example, such devices may not necessarily be components of a gaming device, though they may be configured in such a manner so as to communicate with one or more gaming device processors or any other devices described herein. For example, a peripheral device such as a large display device may be associated with a plurality of gaming devices, and thus may not necessarily be considered a component of any one gaming device. Further, in some embodiments, certain peripheral devices such as card readers may be interchangeable between gaming devices, and thus may be considered a component of a first gaming device while connected thereto, removed from the first gaming device, connected to a second gaming device, and so on. In other embodiments, various peripheral devices may never be considered a component of a particular gaming device. For example, in some embodiments, a peripheral device such as a USB-based portable memory device may store (i) one or more databases described herein, and/or (ii) a program for executing one or more process steps described herein. Such a peripheral device may then be utilized by casino personnel for upgrading/retrofitting existing gaming devices as described herein.

Embodiments described in the present disclosure may be configured to work in a network environment including a computer (e.g., a casino server) that is in communication, via a communications network, with one or more devices, such as gaming devices (e.g., slot machines, video poker machines), kiosks, casino personnel devices, merchant point-of-sale (POS) terminals, component devices (e.g., display screens), peripheral devices (e.g., card readers) and so on. Each of the devices may comprise computers, such as those based on the Intel® Pentium® processor, that are adapted to communicate with the computer. Any number and type of devices may be in communication with the computer. Communication between the devices and the computer, and among the devices, may be direct or indirect, such as over the Internet through a Web site maintained by computer on a remote server or over an online data network including commercial online service providers, bulletin board systems and the like.

Some, but not all, possible communication networks that may comprise the network or be otherwise part of the system include: a local area network (LAN), a wide area network (WAN), the Internet, a telephone line, a cable line, a radio channel (RF), an optical communications line, and a satellite communications link. A variety of communications protocols may be part of the system, including but not limited to: Ethernet (or IEEE 802.3), SAP, SAS™, SuperSAS™, ATP, Bluetooth™, and TCP/IP. Further, in some embodiments, various communications protocols endorsed by the Gaming Standards Association of Fremont, Calif., may be utilized, such as (i) the Gaming Device Standard (GDS), which may facilitate communication between a gaming device and various component devices and/or peripheral devices (e.g., printers, bill acceptors, etc.), (ii) the Best of Breed (BOB) standard, which may facilitate communication between a gaming device and various servers related to play of one or more gaming devices (e.g., servers that assist in providing accounting, player tracking, content management, ticket-in/ticket-out and progressive jackpot functionality), and/or (iii) the System-to-System (S2S) standard, which may facilitate communication between game-related servers and/or casino property management servers (e.g., a hotel server comprising one or more databases that store information about booking and reservations). Communication may be encrypted to ensure privacy and prevent fraud in any of a variety of ways well known in the art.

Those skilled in the art will understand that devices in communication with each other need not be continually transmitting to each other. On the contrary, such devices need only transmit to each other as necessary, and may actually refrain from exchanging data most of the time. For example, a device in communication with another device via the Internet may not transmit data to the other device for weeks at a time. In one embodiment, a server computer may not be necessary and/or preferred. For example, the present disclosure may, in one or more embodiments, be practiced on a stand-alone gaming device and/or a gaming device in communication only with one or more other gaming devices. In such an embodiment, any functions described as performed by the computer or data described as stored on the computer may instead be performed by or stored on one or more gaming devices.

What is claimed is:

1. A method of operating a gaming device, the method comprising:

(i) causing a processor to execute a plurality of instructions stored in a memory device to operate with an input device to receive a wager from a player for a play of a blackjack game, the blackjack game having a first pay table;

(ii) causing the processor to execute the plurality of instructions stored in the memory device to determine at least one initial player hand;

(iii) causing the processor to execute the plurality of instructions stored in the memory device to operate with a display device to display the initial player hand;

(iv) causing the processor to execute the plurality of instructions stored in the memory device to determine at least one initial dealer hand;

(v) causing the processor to execute the plurality of instructions stored in the memory device to operate with the display device to display one card of the initial dealer hand face up and one card of the initial dealer hand face down;

(vi) causing the processor to execute the plurality of instructions stored in the memory device to determine an intermediate player hand;

(vii) causing the processor to execute the plurality of instructions stored in the memory device to operate with the input device and the display device to offer to the player an option to receive a conditional hit card;

(viii) causing the processor to execute the plurality of instructions stored in the memory device to determine if the player accepts or rejects the offer to receive the conditional hit card;

(ix) if the player accepts the offer to receive the conditional hit card:

(a) causing the processor to execute the plurality of instructions stored in the memory device to operate with the display device to display a conditional hit card face down to the player;

(b) causing the processor to execute the plurality of instructions stored in the memory device to determine a final dealer hand; and (c) after determining the final dealer hand:

(1) causing the processor to execute the plurality of instructions stored in the memory device to determine if the final dealer hand loses to or beats the intermediate player hand;

(2) if the final dealer hand loses to the intermediate player hand, causing a first award based on the received wager to be provided to the player according to a second, different pay table; and (3) if the final dealer hand beats the intermediate player hand:

(A) causing the processor to execute the plurality of instructions stored in the memory device to operate with the display device to determine a final player hand by displaying the conditional hit card face up and adding the conditional hit card to the intermediate player hand;

(B) causing the processor to execute the plurality of instructions stored in the memory device to determine if the final player hand loses to or beats the final dealer hand;

(C) if the final player hand loses to the final dealer hand, causing no award to be provided to the player; and (D) if the final player hand beats the final dealer hand, causing the first award to be provided to the player according to the second, different pay table; and (x) if the player rejects the offer to receive the conditional hit card:

(a) causing the processor to execute the plurality of instructions stored in the memory device to determine the final dealer hand; and (b) after determining the final dealer hand:

(1) causing the processor to execute the plurality of instructions stored in the memory device to determine if the final dealer hand loses to or beats the intermediate player hand;

(2) if the final dealer hand loses to the intermediate player hand, causing a second, different award based on the received wager to be provided to the player according to the first pay table; and (3) if the final dealer hand beats the intermediate player hand, causing no award to be provided to the player.

2. The method of claim 1, which includes causing the processor to execute the plurality of instructions stored in the memory device to operate with the input device to enable the player to place an additional wager to accept the offer to receive the conditional hit card.

3. The method of claim 1, wherein the first award to be provided to the player according to the second, different pay table is less than the second, different award to be provided to the player according to the first pay table.

4. A method of operating a gaming device, the method comprising:

(i) causing a processor to execute a plurality of instructions stored in a memory device to operate with an input device to receive a first wager from a player for a play of a blackjack game;

(ii) causing the processor to execute the plurality of instructions stored in the memory device to determine an initial player hand;

(iii) causing the processor to execute the plurality of instructions stored in the memory device to operate with a display device to display the initial player hand;

(iv) causing the processor to execute the plurality of instructions stored in the memory device to determine an initial dealer hand;

(v) causing the processor to execute the plurality of instructions stored in the memory device to operate with the display device to display one card of the initial dealer hand face up and one card of the initial dealer hand face down;

(vi) causing the processor to execute the plurality of instructions stored in the memory device to determine an intermediate player hand;

(vii) causing the processor to execute the plurality of instructions stored in the memory device to operate with the input device to enable the player to place a second wager to receive a conditional hit card;

(viii) if the player places the second wager to receive the conditional hit card:

(a) causing the processor to execute the plurality of instructions stored in the memory device to operate with the display device to display the conditional hit card face down to the player;

(b) causing the processor to execute the plurality of instructions stored in the memory device to determine a final dealer hand; and (c) after determining the final deal hand:

(1) causing the processor to execute the plurality of instructions stored in the memory device to determine if the final dealer hand loses to or beats the intermediate player hand;

(2) if the final dealer hand loses to the intermediate player hand, causing a first award to be provided to the player in accordance with a first pay table;

(3) if the final dealer hand beats the intermediate player hand:

(A) causing the processor to execute the plurality of instructions stored in the memory device to operate with the display device to determine a final player hand by displaying the conditional hit card face up and adding the conditional hit card to the intermediate player hand;

(B) causing the processor to execute the plurality of instructions stored in the memory device to determine if the final dealer hand loses to or beats the final player hand;

(C) if the final dealer hand loses to the final player hand, causing a second, different award to be provided to the player in accordance with a second, different pay table; and (D) if the final dealer hand beats the final player hand, causing no award to be provided to the player; and (ix) if the player does not place the second wager to receive the conditional hit card:

(a) causing the processor to execute the plurality of instructions stored in the memory device to determine the final dealer hand; and (b) after determining the final dealer hand:

(1) causing the processor to execute the plurality of instructions stored in the memory device to determine if the final dealer hand loses to or beats the intermediate player hand;

(2) if the final dealer hand loses to the intermediate player hand, causing the first award to be provided to the player according to the first pay table; and (3) if the final dealer hand beats the intermediate player hand, causing no award to be provided to the player.

5. The method of claim 4, wherein the second wager is equal to the first wager.

6. The method of claim 4, wherein the first award is equal to the first wager.

7. The method of claim 4, wherein the first and second awards are equal.

8. The method of claim 4, wherein the second, different award is less than the first wager.

9. The method of claim 4, wherein the second, different award is equal to the second wager.

10. The method of claim 4, wherein the first award is based on the first wager at even odds and the second, different award is based on the second wager at less than even odds.

11. A method of operating a gaming device, the method comprising:

(i) causing a processor to execute a plurality of instructions stored in a memory device to operate with an input device to receive a first wager from a player for a play of a card game;

(ii) causing the processor to execute the plurality of instructions stored in the memory device to determine an initial player hand;

(iii) causing the processor to execute the plurality of instructions stored in the memory device to operate with a display device to display the initial player hand;

(iv) causing the processor to execute the plurality of instructions stored in the memory device to determine an initial dealer hand;

(v) causing the processor to execute the plurality of instructions stored in the memory device to operate with the display device to display one card of the initial dealer hand face up and one card of the initial dealer hand face down;

(vi) causing the processor to execute the plurality of instructions stored in the memory device to determine an intermediate player hand, the determination based on the initial player hand;

(vii) causing the processor to execute the plurality of instructions stored in the memory device to determine whether or not the player places a second wager to receive a conditional hit card;

(viii) if the player places the second wager to receive the conditional hit card:

(a) causing the processor to execute the plurality of instructions stored in the memory device to operate with the display device to display a conditional hit card face down to a player;

(b) causing the processor to execute the plurality of instructions stored in the memory device to determine a final dealer hand;

(c) after determining the final dealer hand:

(1) causing the processor to execute the plurality of instructions stored in the memory device to determine if the final dealer hand loses to or beats the intermediate player hand;

(2) if the final dealer hand loses to the intermediate player hand, causing a first award to be provided to the player in accordance with a first pay table; and (3) if the final dealer hand beats the intermediate player hand:

(A) causing the processor to execute the plurality of instructions stored in the memory device to operate with the display device to display the conditional hit card face up;

(B) causing the processor to execute the plurality of instructions stored in the memory device to operate with the display device to determine a final player hand, the final player hand including the conditional hit card displayed face up and the intermediate player hand;

(C) causing the processor to execute the plurality of instructions stored in the memory device to determine if the final dealer hand loses to or beats the final player hand;

(D) if the final dealer hand loses to the final player hand, causing a second, different award to be provided to the player in accordance with the first pay table; and (E) if the final dealer hand beats the final player hand, causing no award to be provided to the player; and (ix) if the player does not place the second wager to receive the conditional hit card:

(a) causing the processor to execute the plurality of instructions stored in the memory device to determine the final dealer hand; and (b) after determining the final dealer hand:

(1) causing the processor to execute the plurality of instructions stored in the memory device to determine if the final dealer hand loses to or beats the intermediate player hand;

(2) if the final dealer hand loses to the intermediate player hand, causing the first award to be provided to the player according to the first pay table; and (3) if the final dealer hand beats the intermediate player hand, causing no award to be provided to the player.

12. The method of claim 11, which includes causing the processor to execute the plurality of instructions stored in the memory device to operate with the input device to enable the player to place the second wager to receive the conditional hit card.

13. The method of claim 11, which includes causing the processor to execute the plurality of instructions stored in the memory device to operate with the input device to enable the player to place the second wager after the intermediate player hand has been determined.

14. The method of claim 11, which includes causing the processor to execute the plurality of instructions stored in the memory device to operate with the input device to enable the player to place the second wager before the intermediate player hand has been determined.

15. The method of claim 11, wherein if the player places the second wager to receive the conditional hit card, the first award equals the second award.

16. The method of claim 11, wherein the second wager is equal to the first wager received from the player.

17. The method of claim 11, wherein the first award is greater than the second award.

18. The method of claim 17, wherein if the final dealer hand loses to the final player hand, the second award is based on the second wager at less than even odds in accordance with the first pay table.

19. The method of claim 11, which includes, if the player places the second wager to receive the conditional hit card, causing the processor to execute the plurality of instructions stored in the memory device to operate with the display device to display the conditional hit card is face down to the player after the final dealer hand is determined.

20. The method of claim 11, which includes, if the player places the second wager to receive the conditional hit card, causing the processor to execute the plurality of instructions stored in the memory device to operate with the display device to display the conditional hit card face down to the player after the intermediate player hand is determined.

21. The method of claim 11, wherein the final player hand includes at least one of the cards of the intermediate player hand and the conditional hit card.

22. The method of claim 11, wherein the first award is based on the first wager at even odds in accordance with the first pay table and the second award is based on the second wager at even odds in accordance with the first pay table.

23. The method of claim 11, which includes causing the processor to execute the plurality of instructions stored in the memory device to operate with the input device to enable the player to determine the final player hand after displaying the conditional hit card face up to the player.

24. A method of operating a gaming device, the method comprising:

(i) causing a processor to execute a plurality of instructions stored in a memory device to operate with an input device to receive a wager from a player of a card game;

(ii) causing the processor to execute the plurality of instructions stored in the memory device to determine an initial player hand including a first plurality of cards;

(iii) causing the processor to execute the plurality of instructions stored in the memory device to operate with a display device to display the determined initial player hand;

(iv) causing the processor to execute the plurality of instructions stored in the memory device to determine an initial dealer hand including a second, different plurality of cards;

(v) causing the processor to execute the plurality of instructions stored in the memory device to operate with the display device to display the determined initial deal hand;

(vi) causing the processor to execute the plurality of instructions stored in the memory device to determine an intermediate player hand, the intermediate hand including at least the first plurality of cards of the initial player hand;

(vii) causing the processor to execute the plurality of instructions stored in the memory device to operate with the display device to display the determined intermediate player hand;

(viii) causing the processor to execute the plurality of instructions stored in the memory device to determine if the player accepts or rejects an offer to receive a conditional card in addition to the intermediate player hand;

(ix) causing the processor to execute the plurality of instructions stored in the memory device to determine a final dealer hand;

(x) causing the processor to execute the plurality of instructions stored in the memory device to operate with the display device to display the determined final dealer hand; and (xi) after determining and displaying the final dealer hand:

(a) if the player accepts the offer to receive the conditional card:

(1) causing the processor to execute the plurality of instructions stored in the memory device to associate the conditional card with the intermediate player hand;

(2) causing the processor to execute the plurality of instructions stored in the memory device to determine if the final dealer hand loses to or beats the intermediate player hand;

(3) if the final dealer hand loses to the intermediate player hand, causing a first award to be provided to the player;

(4) if the final dealer hand beats the intermediate player hand:

(A) causing the processor to execute the plurality of instructions stored in the memory device to operate with the display device to display the conditional card;

(B) causing the processor to execute the plurality of instructions stored in the memory device to operate with the display device to cause the displayed conditional card to replace one of the first plurality of cards of the intermediate player hand to determine a final player hand;

(C) causing the processor to execute the plurality of instructions stored in the memory device to determine if the final dealer hand loses to or beats the final player hand;

(D) if the final dealer hand loses to the final player hand, causing a second, different award to be provided to the player; and (E) if the final dealer hand beats the final player hand, causing no award to be provided to the player; and (b) if the player rejects the offer to receive the conditional card:

(1) causing the processor to execute the plurality of instructions stored in the memory device to determine if the final dealer hand loses to or beats the intermediate player hand;

(2) if the final dealer hand loses to the intermediate player hand, causing the first award to be provided to the player; and (3) if the final dealer hand beats the intermediate player hand, causing no award to be provided to the player.

25. The method of claim 24, which includes causing the processor to execute the plurality of instructions stored in the memory device to operate with the input device to enable the player to pick one of the first plurality of cards of the intermediate player hand to be replaced by the conditional card.

26. The method of claim 24, wherein the card game is at least one of blackjack and baccarat.

27. The method of claim 24, wherein the second, different award is less than the first award.

* * * * *

UNITED STATES PATENT AND TRADEMARK OFFICE

CERTIFICATE OF CORRECTION

PATENT NO. : 7,918,724 B2
APPLICATION NO. : 12/255361
DATED : April 5, 2011
INVENTOR(S) : Jay S. Walker et al.

It is certified that error appears in the above-identified patent and that said Letters Patent is hereby corrected as shown below:

In Claim 1, column 25, line 11, replace “a” with --the--.

In Claim 4, column 26, line 46, after “table;” insert --and--.

In Claim 11, column 27, line 60, replace “a” with --the--.

In Claim 11, column 27, line 64, after “hand;” insert --and--.

In Claim 24, column 29, line 47, replace “deal” with --dealer--.

In Claim 24, column 30, line 18, after “player;” insert --and--.

Signed and Sealed this
Twelfth Day of July, 2011

David J. Kappos

David J. Kappos
*Director of the United States Patent and Trademark Office*